US011573586B2

(12) United States Patent
Köse et al.

(10) Patent No.: US 11,573,586 B2
(45) Date of Patent: Feb. 7, 2023

(54) METHOD AND APPARATUS FOR MITIGATING PERFORMANCE DEGRADATION IN DIGITAL LOW-DROPOUT VOLTAGE REGULATORS (DLDOS) CAUSED BY LIMIT CYCLE OSCILLATION (LCO) AND OTHER FACTORS

(71) Applicants: University of South Florida, Tampa, FL (US); REGENTS OF THE UNIVERSITY OF MINNESOTA, Minneapolis, MN (US)

(72) Inventors: Selçuk Köse, Tampa, FL (US); Longfei Wang, Tampa, FL (US); S. Karen Khatamifard, Los Angeles, CA (US); Ulya R. Karpuzcu, Minneapolis, MN (US)

(73) Assignees: UNIVERSITY OF SOUTH FLORIDA, Tampa, FL (US); REGENTS OF THE UNIVERSITY OF MINNESOTA, Minneapolis, MN (US)

( * ) Notice: Subject to any disclaimer, the term of this patent is extended or adjusted under 35 U.S.C. 154(b) by 0 days.

(21) Appl. No.: 17/410,896

(22) Filed: Aug. 24, 2021

(65) Prior Publication Data

US 2022/0043473 A1 Feb. 10, 2022

Related U.S. Application Data

(63) Continuation of application No. 16/567,858, filed on Sep. 11, 2019, now Pat. No. 11,099,591.
(Continued)

(51) Int. Cl.
*G05F 1/59* (2006.01)
*G05F 1/614* (2006.01)
(Continued)

(52) U.S. Cl.
CPC ..... *G05F 1/59* (2013.01); *G05F 1/56* (2013.01); *G05F 1/563* (2013.01); *G05F 1/565* (2013.01); *G05F 1/575* (2013.01); *G05F 1/614* (2013.01)

(58) Field of Classification Search
CPC . G05F 1/56; G05F 1/563; G05F 1/565; G05F 1/575; G05F 1/614; G05F 1/59
See application file for complete search history.

(56) References Cited

U.S. PATENT DOCUMENTS 9,946,281 B1 * 4/2018 Huang ..... G05F 1/565
2004/0150610 A1 * 8/2004 Zebedee ..... G11C 19/28 345/100
2018/0329440 A1 * 11/2018 Jefremow ..... G05F 1/575

* cited by examiner

*Primary Examiner* — Kyle J Moody
*Assistant Examiner* — Lakaisha Jackson

(57) ABSTRACT

A DLDO has a configuration that mitigates performance degradation associated with limit cycle oscillation (LCO). The DLDO comprises a clocked comparator, an array of power transistors, a digital controller and a clock pulsewidth reduction circuit. The digital controller comprises control logic configured to generate control signals that cause the power transistors to be turned ON or OFF in accordance with a preselected activation/deactivation control scheme. The clock pulsewidth reduction circuit receives an input clock signal having a first pulsewidth and generates the DLDO clock signal having the preselected pulsewidth that is narrower that the first pulsewidth, which is then delivered to the clock terminals of the clocked comparator and the digital controller. The narrower pulsewidth of the DLDO clock reduces the LCO mode to mitigate performance degradation caused by LCO.

20 Claims, 17 Drawing Sheets

Related U.S. Application Data

(60) Provisional application No. 62/729,728, filed on Sep. 11, 2018.

(51) Int. Cl.

| | |
|---|---|
| *G05F 1/563* | (2006.01) |
| *G05F 1/56* | (2006.01) |
| *G05F 1/575* | (2006.01) |
| *G05F 1/565* | (2006.01) |

| $Q_1$ | $Q_2$ | $Q_3$ | $Q_4$ | $Q_5$ | $Q_6$ | ... | ... | $Q_{N-1}$ | $Q_N$ |
|---|---|---|---|---|---|---|---|---|---|

(1) Initialize: all $M_i$ turned off

| 1 | 1 | 1 | 1 | 1 | 1 | ... | ... | 1 | 1 |
|---|---|---|---|---|---|---|---|---|---|

(2) Step k

| 0 | 0 | 1 | 1 | 1 | 1 | ... | ... | 1 | 1 |
|---|---|---|---|---|---|---|---|---|---|

(3) Step k+1: Shift right ➡

| 0 | 0 | 0 | 1 | 1 | 1 | ... | ... | 1 | 1 |
|---|---|---|---|---|---|---|---|---|---|

(4) Step k+2: Shift right ➡

| 0 | 0 | 0 | 0 | 1 | 1 | ... | ... | 1 | 1 |
|---|---|---|---|---|---|---|---|---|---|

(5) Step k+3: Shift left ⬅

| 0 | 0 | 0 | 1 | 1 | 1 | ... | ... | 1 | 1 |
|---|---|---|---|---|---|---|---|---|---|

(6) Step k+4: Shift left ⬅

| 0 | 0 | 1 | 1 | 1 | 1 | ... | ... | 1 | 1 |
|---|---|---|---|---|---|---|---|---|---|

FIG. 9

| $Q_1$ | $Q_2$ | $Q_3$ | $Q_4$ | $Q_5$ | $Q_6$ | ... | ... | $Q_{N-1}$ | $Q_N$ |
|---|---|---|---|---|---|---|---|---|---|

(1) Initialize: all $M_i$ turned off

| 1 | 1 | 1 | 1 | 1 | 1 | ... | ... | 1 | 1 |
|---|---|---|---|---|---|---|---|---|---|

(2) Step k

| 1 | 1 | 0 | 0 | 1 | 1 | ... | ... | 1 | 1 |
|---|---|---|---|---|---|---|---|---|---|

(3) Step k+1: Shift right ➡

| 1 | 1 | 0 | 0 | 0 | 1 | ... | ... | 1 | 1 |
|---|---|---|---|---|---|---|---|---|---|

(4) Step k+2: Shift right ➡

| 1 | 1 | 0 | 0 | 0 | 0 | ... | ... | 1 | 1 |
|---|---|---|---|---|---|---|---|---|---|

(5) Step k+3: Shift right ➡

| 1 | 1 | 1 | 0 | 0 | 0 | ... | ... | 1 | 1 |
|---|---|---|---|---|---|---|---|---|---|

(6) Step k+4: Shift right ➡

| 1 | 1 | 1 | 1 | 0 | 0 | ... | ... | 1 | 1 |
|---|---|---|---|---|---|---|---|---|---|

FIG. 10

TABLE I
TECHNOLOGY AND ARCHITECTURE PARAMETERS

| |
|---|
| Technology node: 22nm, Frequency: 4.0GHz<br>TDP: 150W, Area: $441mm^2$, Vdd: 1.03V |
| # cores: 8, issue width: 8<br>64 architectured FRF, 32 architectured IRF |
| L1-I cache: 32KB, 8-way, 64B, LRU, 1-cycle hit<br>L1-D cache: 64KB, 8-way, 64B, LRU, 1-cycle hit<br>L2 cache: 512KB, 8-way, 128B, LRU, 11-cycle hit<br>L3 cache: 64MB, 8-way, 128B, LRU, 30-cycle hit |

TABLE II

LOAD CHARACTERISTICS OF DIFFERENT FUNCTIONAL BLOCKS WITHIN ONE CORE OF AN IBM POWER8 LIKE MICROPROCESSOR CHIP UNDER ALL EXPERIMENTED BENCHMARKS

| | IFU | LSU | ISU | EXU | L2 |
|---|---|---|---|---|---|
| Min $I_{load}$ (A) | 0.091 | 0.172 | 0.125 | 0.251 | 0.178 |
| Max $I_{load}$ (A) | 3.245 | 12.092 | 1.356 | 5.056 | 2.195 |
| Avg $I_{load}$ (A) | 1.138 | 0.908 | 0.201 | 1.294 | 1.719 |

FIG. 17

TABLE III
CONVENTIONAL DLDO PERFORMANCE DEGRADATION FOR DIFFERENT FUNCTIONAL BLOCKS UNDER ALL EXPERIMENTED BENCHMARKS FOR A FIVE-YEAR TIME FRAME

| | IFU | LSU | ISU | EXU | L2 |
|---|---|---|---|---|---|
| % $I_{pMOS}$ degradation | 16.2 | 21.4 | 15.3 | 16.6 | 15.1 |
| % $T_R$ degradation | 9.4 | 12.9 | 8.9 | 9.7 | 8.7 |
| % $\Delta V$ degradation | 6.4 | 8.7 | 6.1 | 6.6 | 6 |

FIG. 18

TABLE IV

TFF SETUP TIME, LOGIC DELAY, AND COMPARATOR DELAY BEFORE AND AFTER A 5-YEAR AGING PERIOD

| | TFF setup time | Logic delay | Comparator delay |
|---|---|---|---|
| Fresh (ps) | 170 | 209.6 | 171.5 |
| Aged 5 yrs (ps) | 180 | 227.4 | 225 |

FIG. 19

TABLE V

MAXIMUM LCO MODE UNDER DIFFERENT SAMPLING CLOCK FREQUENCY AND LOAD CURRENT CONDITION FOR CDE AND AA DLDO

| CDE/AA LCO mode | Sampling clock frequency $f_{clk}$ (MHz) | | | | |
|---|---|---|---|---|---|
| $I_{load}$ (mA) | 10 | 50 | 100 | 300 | 500 |
| 10 | 4/2 | 8/6 | 11/9 | 20/18 | 27/27 |
| 100 | 3/2 | 3/2 | 4/3 | 6/6 | 8/8 |
| 500 | 3/2 | 3/2 | 3/2 | 3/3 | 4/4 |

FIG. 22

METHOD AND APPARATUS FOR MITIGATING PERFORMANCE DEGRADATION IN DIGITAL LOW-DROPOUT VOLTAGE REGULATORS (DLDOS) CAUSED BY LIMIT CYCLE OSCILLATION (LCO) AND OTHER FACTORS

CROSS-REFERENCE TO RELATED APPLICATIONS

This is a continuation of U.S. patent application Ser. No. 16/567,858, filed Sep. 11, 2019, which claims the benefit of, U.S. provisional application No. 62/729,728, filed on Sep. 11, 2018, entitled "Reduced Clock Pulse Width Digital Low-Dropout Regulator," each of which are hereby incorporated by reference herein in their entirety.

GOVERNMENT RIGHTS STATEMENT

This invention was made with government support under grant No. CCF1350451 awarded by the National Science Foundation. The government has certain rights in this invention.

TECHNICAL FIELD

The invention relates to digital low-dropout voltage regulators (DLDOs).

BACKGROUND

Distributed on-chip voltage regulation in fine temporal and spatial granularity enables fast and timely control of the operating point. Thereby, the operating voltage and frequency can better match the needs of the workload to maximize energy efficiency. As a function of the workload, throughout the execution time, different components of a processor chip exhibit different microarchitectural activities, which translates into different demands for current to be pulled from the respective regulators. Different components of the processor chip also show different degrees of tolerance to errors, which may result from deviation of design parameters from their target values due to device wearout, voltage noise, temperature, or process variations. For example, it has been observed that the emerging recognition, mining, and synthesis applications can tolerate errors in the data flow but not in control.

Heterogeneous distributed on-chip voltage regulation has been explored to best capture spatiotemporal variations in current demand of different processor components, where the regulator operating regimes are tailored to the activity range of the respective load (processor component). Such tailoring can be achieved by: 1) keeping the regulator design constant across chip but making each regulator reconfigurable or 2) by designing each regulator from the groundup to match different load conditions.

The major transistor aging mechanisms of DLDOs include bias temperature instability (BTI), hot carrier injection, and time-dependent dielectric breakdown, among which BTI is the dominant reliability concern for nanometer integrated circuits design. BTI can induce threshold voltage increase and consequent circuit-level performance degradation. Positive BTI (PBTI) induces aging of nMOS transistors while negative BTI (NBTI) causes aging of pMOS transistors. The impact of BTI aging mechanism is a strong function of temperature, electrical stress, and time.

FIG. 1 is a schematic diagram of a conventional DLDO 2. The DLDO 2 is composed of N parallel pMOS transistors $M_i$ (i=1, . . . , N) connected between the input voltage $V_{in}$ and output voltage $V_{out}$, and a feedback control loop implemented with a clocked comparator 3 and a digital controller 4. The value of $V_{out}$ and reference voltage $V_{ref}$ are compared through the comparator 3 at the rising edge of the clock signal, clk. A larger (smaller) number of $M_i$ are turned on/off through the digital controller 4 output signals $Q_i$ (i=1, . . . , N) if $V_{out}<V_{ref}$, $V_{cmp}$=H ($V_{out}>V_{ref}$, $V_{cmp}$=L). FIG. 2 is a block diagram of a bi-directional shift register (bDSR) 5 that is conventionally implemented for the digital controller 4 of the DLDO 2 shown in FIG. 1 to turn on (off) power transistors $M_1$ to $M_m$ ($M_{m+1}$ to $M_N$) with the value of m decided by the load current $I_{out}$. FIG. 3 is a diagram showing the operation of the bDSR 5 shown in FIG. 2. At a certain step k+1, $M_{m+1}$ ($M_m$) is turned on (off) if $V_{cmp}$=H ($V_{cmp}$=L) and bDSR 5 shifts right (left) as demonstrated in FIG. 3.

The DLDO 2 needs to be able to supply the maximum possible load current $I_{max}$. It is, however, demonstrated that, within most practical applications, including but not limited to smart phone and chip multiprocessors, less than the average power is consumed most of the time. The application environment of DLDO together with the conventional activation scheme of $M_i$ leads to the heavy use of $M_1$ to $M_m$ and less or even no use of $M_{m+1}$ to $M_N$. This scheme can therefore introduce serious degradation to $M_1$ to $M_m$ due to NBTI. Meanwhile, the error tolerance capability of different functional blocks can be different, which necessitates area-quality tradeoff for aging mitigation-induced area overhead (OH).

Furthermore, DLDOs experience inherent limit cycle oscillation (LCO) in steady state due to inherent quantization errors. The number of power transistors that are periodically turned ON or OFF in steady state is the mode of LCO. A larger LCO mode under a certain load current $I_{load}$ and clock frequency $f_{clk}$ conditions may lead to larger steady-state output voltage ripple, which can degrade the performance of the DLDO. Larger delay between the clocked comparator and shift register is detrimental to LCO. The BTI-induced control loop degradation can potentially further exacerbate the LCO mode.

SUMMARY

A DLDO is disclosed herein having a configuration that mitigates performance degradation of the DLDO caused by LCO. The DLDO comprises a clocked comparator, an arraof N power transistors, a digital controller, and a clock pulsewidth reduction circuit. A first terminal of the clocked comparator receives a reference voltage signal, Vref. A second input terminal of the clocked comparator receives an output voltage signal Vout output from an output voltage terminal of the DLDO. A clock terminal of the clocked comparator receives a DLDO clock signal, clk, having a preselected pulse width. The clocked comparator compares the reference voltage signal, Vref, with the output voltage signal and outputs a comparator output voltage, Vcmp. The array of N power transistors are electrically connected in parallel with one another, where N is a positive integer that is greater than or equal to one. The first terminal of each power transistor is electrically coupled to the output voltage terminal of the DLDO. The digital controller comprises control logic configured to activate and deactivate the power transistors of the DLDO in accordance with a preselected activation/deactivation control scheme. The control signals cause the power transistors to be turned ON or OFF in accordance with the preselected activation/deactivation control scheme. The clock pulsewidth reduction circuit is configured to receive an input clock signal, CLK, having a first pulsewidth and to generate the DLDO clock signal, clk, having the preselected pulsewidth. The preselected pulsewidth of the DLDO clock signal, clk, is smaller than the first pulsewidth of the input clock signal, CLK. An output terminal of the clock pulsewidth reduction circuit is electrically coupled to the clock terminals of the clocked comparator and the digital controller for delivering the DLDO clock signal, clk, to the clocked comparator and to the digital controller.

A method is disclosed herein for mitigating performance degradation in a DLDO caused by LCO. The method comprises:

- in a clock pulsewidth reduction circuit, receiving an input clock signal, CLK, having a first pulsewidth;
- in the clock pulsewidth reduction circuit, generating a DLDO clock signal, clk, having a preselected pulsewidth, the preselected pulsewidth of the DLDO clock signal, clk, being smaller than the first pulsewidth of the input clock signal, CLK;
- outputting the DLDO clock signal, clk, from an output terminal of the clock pulsewidth reduction circuit to respective clock terminals of a clocked comparator of the DLDO and a digital controller of the DLDO;
- in the clocked comparator of the DLDO, receiving a reference voltage signal, Vref, at a first input terminal of the clocked comparator, receiving an output voltage signal, Vout, output from an output voltage terminal of the DLDO at a second input terminal of the clocked comparator, and receiving the DLDO clock signal, clk, at the clock terminal of the clocked comparator;
- in the clocked comparator, comparing the reference voltage signal, Vref, with the output voltage signal, Vout, and outputting a comparator output voltage, Vcmp; and
- in a digital controller of the DLDO, receiving the comparator output voltage, Vcmp, at an input terminal of the digital controller, receiving the DLDO clock signal, clk, at the clock terminal of the digital controller, and performing a preselected activation/deactivation control scheme that causes the digital controller to output control signals to an array of power transistors of the DLDO from respective output terminals of the digital controller to cause the power transistors to be turned ON or OFF in accordance with the preselected activation/deactivation control scheme.

These and other features and advantages will become apparent from the following description, drawings and claims.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

FIG. 9 is a diagram illustrating the operations at steady state of the bDSR shown in FIG. 2.

FIG. 10 illustrates the operations at steady state of the uDSR shown in FIG. 7.

FIG. 17 is a table listing load characteristics of the different functional blocks shown in FIG. 16 under experimented benchmarks.

FIG. 18 is a table listing simulation results for conventional DLDO performance degradation for different functional blocks shown in FIG. 16 under experimented benchmarks for a five-year time frame.

FIG. 19 is a table summarizing the fresh and aged TFF setup time $t^{st}_{r}$, logic delay $t^{d}_{r}$, and comparator delay $t^{d}_{c}$ obtained during the simulation of the A-A DLDO having the design shown in in FIG. 6 using the reduced clock pulsewidth circuitry of the type shown in FIG. 13.

FIG. 22 is a table that gives the simulated maximum limit cycle oscillation (LCO) mode under different sampling clock frequencies and load current conditions for a CDE DLDO of the type shown in FIG. 1 and the A-A DLDO of the type shown in FIG. 6 employing the reduced clock pulsewidth circuitry of the type shown in FIG. 13.

DETAILED DESCRIPTION

Figure 1:
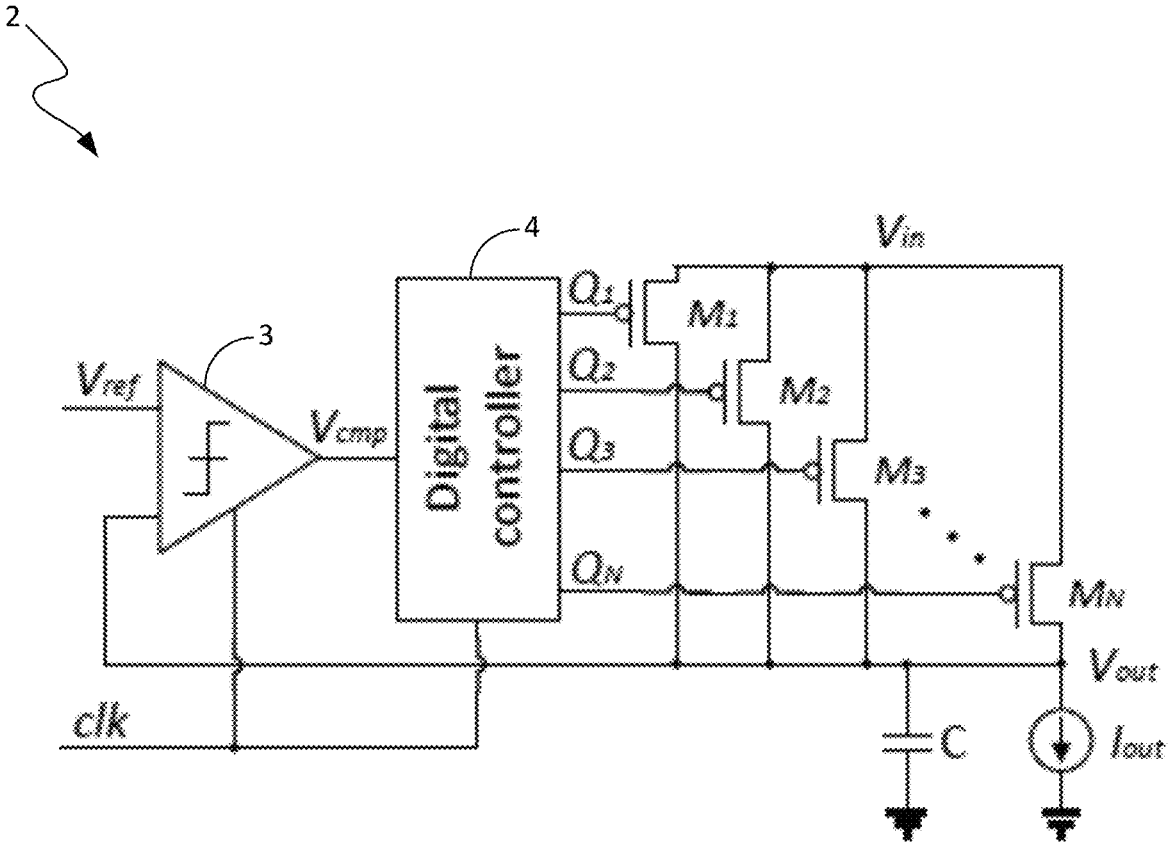
FIG. 1 (PRIOR ART)
FIG. 1 is a schematic diagram of a conventional DLDO.

The present disclosure discloses a DLDO having a configuration that mitigates performance degradation of the DLDO caused by LCO. The DLDO comprises a clocked comparator, an array of power transistors, a digital controller and a clock pulsewidth reduction circuit. The clocked comparator and the digital controller have clock terminals for receiving a DLDO clock signal having a preselected pulsewidth. The digital controller comprises control logic configured to control signals that cause the power transistors to be turned ON or OFF in accordance with the preselected activation/deactivation control scheme. The clock pulsewidth reduction circuit comprises clock reduction logic configured to receive a clock signal having a first pulsewidth and to generate the DLDO clock signal having the preselected pulsewidth that is narrower that the first pulsewidth. The DLDO clock signal is delivered to the clock terminals of the clocked comparator and of the digital controller. The narrower pulsewidth of the DLDO clock reduces the LCO mode to mitigate performance degradation caused by LCO.

In the following detailed description, for purposes of explanation and not limitation, exemplary, or representative, embodiments disclosing specific details are set forth in order to provide a thorough understanding of inventive principles and concepts. However, it will be apparent to one of ordinary skill in the art having the benefit of the present disclosure that other embodiments according to the present teachings that are not explicitly described or shown herein are within the scope of the appended claims. Moreover, descriptions of well-known apparatuses and methods may be omitted so as not to obscure the description of the exemplary embodiments. Such methods and apparatuses are clearly within the scope of the present teachings, as will be understood by those of skill in the art. It should also be understood that the word "example," as used herein, is intended to be non-exclusionary and non-limiting in nature.

The terminology used herein is for purposes of describing particular embodiments only, and is not intended to be limiting. The defined terms are in addition to the technical, scientific, or ordinary meanings of the defined terms as commonly understood and accepted in the relevant context.

The terms "a," "an" and "the" include both singular and plural referents, unless the context clearly dictates otherwise. Thus, for example, "a device" includes one device and plural devices. The terms "substantial" or "substantially" mean to within acceptable limits or degrees acceptable to those of skill in the art. The term "approximately" means to within an acceptable limit or amount to one of ordinary skill in the art.

An area that has not yet been explored is how the aforementioned heterogeneous distributed on-chip voltage regulation can help in trading the program output quality for area overhead (OH) by, e.g., assigning error-prone (i.e., slower and/or less accurate) regulators to feed processor components in charge of data flow which can tolerate errors. Control heavy components, on the other hand, should not be permitted to leave the error-free zone to avoid catastrophic program termination or excessive loss in program output quality even if the program does not crash.

To this end, it is important to understand the type and impact of errors that voltage regulators can introduce to the system in order to assess what extent such regulator-induced errors can be masked by their respective loads (i.e., data flow heavy processor components) and how regulator-induced errors interact with load-induced potential errors in determining the final computation accuracy. This disclosure sheds light on this issue by quantifying the impact of one of the most prevalent reliability concerns, aging, on regulator robustness.

As an essential part of large scale integrated circuits, on-chip voltage regulators need to be active most of the time to provide the required power to the load circuit. The load current and temperature can vary quite a bit, especially for microprocessor applications. These variations partially contribute to different aging mechanisms of on-chip voltage regulators, which should be considered to avoid overdesign for a targeted lifetime. Additionally, in certain processor components that can show higher degrees of tolerance to errors, the regulators can be intentionally under-designed to save valuable chip area and potentially power-conversion efficiency. In other words, a heterogeneous distributed power delivery network can be designed comprising different DLDOs including accurate DLDOs that house additional circuitry to mitigate the aging-induced supply voltage variations and approximate DLDOs that are intentionally under-designed to mitigate, just enough, aging-induced variations. The quality of the supply voltage directly affects the data path delay and signal quality, and fluctuations in the supply voltage result in delay uncertainty and clock jitter. According to one aspect of the present disclosure, the supply noise tolerance of certain processor components is used as an "area quality control knob" that compromises the quality of the supply voltage to save valuable chip area.

Several studies have been performed regarding the reliability issues in nanometer CMOS designs. To date, only a limited amount of work has been done on the reliability of on-chip voltage regulators. To this end, the present disclosure provides a quantitative analysis of aging effects on on-chip voltage regulators considering load current characteristics and temperature variations as well as efficient reliability enhancement techniques under arbitrary load conditions.

As compared to other voltage regulator types, the emerging DLDO has gained impetus due to the design simplicity, easiness for integration, high power density, and fast response. DLDOs have demonstrated major advantages in modern processors including the recent IBM POWER8 processor. More importantly, as compared to the analog LDOs, a DLDO can provide certain advantages for low-power and low-voltage IoT applications due to its capability for low supply voltage operations. However, as pMOS is used as the power transistor for DLDOs, NBTI-induced degradations largely affect important performance metrics such as the maximum output current capability $I_{max}$, load response time $T_R$, and magnitude of the droop $\Delta V$. Meanwhile, as indicated above, the combined NBTI- and PBTI-induced control loop degradations can potentially increase the mode of LCOs within DLDOs and adversely affect the steady-state output voltage ripple performance. It is, therefore, imperative to investigate aging mitigation techniques for DLDOs to achieve reliable operation of critical components. Alternatively, when a circuit component can tolerate higher degrees of errors, the DLDOs can be designed with minimal area OH, achieving heterogeneous power delivery.

Based on this understanding, the present disclosure discloses a methodology for designing a DLDO that allows the DLDO to be designed at the design time based on the supply noise resiliency requirement of the circuitry it the DLDO powers. Since the number of DLDOs can be as high as several hundred in modern processors, the area and number of DLDOs can be easily scaled to satisfy the diverse needs of systems that house components with varying degrees of noise tolerance.

The present disclosure is organized as follows. Background information regarding the conventional DLDO shown in FIG. 1 is introduced in Section I. BTI-induced DLDO regulator performance degradation including $I_{max}$, $T_R$, ΔV, and mode of LCOs is demonstrated theoretically in Section II. A representative embodiment of an aging-aware (A-A) DLDO in accordance with the inventive principles and concepts is described in Section III. A benefits evaluation of the A-A DLDO through simulation of an IBM POWER8 like processor is provided in Section IV. A tradeoff between the area OH of voltage regulators and program output quality is detailed in Section V. Concluding remarks are offered in Section VI.

Section I

A. Bias Temperature Instability of the Conventional DLDO

NBTI can introduce significant $V_{th}$ degradations to pMOS transistors due to negatively applied gate to source voltage $V_{gs}$. The increase in $|V_{th}|$ due to NBTI is considered to be related to the generation of interface traps at the Si/SiO2 interface when there is a gate voltage. $|V_{th}|$ increases when electrical stress is applied and partially recovers when stress is removed. This process is commonly explained using a reaction-diffusion (R-D) model. The $V_{th}$ degradation can be estimated during each stress and recovery phase using a cycle-to-cycle model and can also be evaluated using a long-term reliability model. As the long-term reliability evaluation is the focus of this work, the analytical model for long-term worst case threshold voltage degradation $\Delta V_{th}$ estimation can be expressed as:

$$\Delta V_{th} = K_{lt}\sqrt{C_{ox}(|V_{gs}| - |V_{th}|)}\, e^{\frac{-E_a}{kT}} (\alpha t)^{\frac{1}{6}} \tag{1}$$

where $C_{ox}$, k, T, α, and t are, respectively, the oxide capacitance, Boltzmann constant, temperature, the fraction of time (activity factor) when the device is under stress, and operation time. $K_{lt}$ and $E_a$ are the fitting parameters to match the model with the experimental data. Note that NBTI recovery phase is already included in the model.

Section II. Aging-Induced DLDO Performance Degradation $I_{max}$, $T_R$, and ΔV are among the most important design parameters for DLDOs. The effect of NBTI-induced degradations on these important performance metrics is examined in this section.

A. Maximum Current Supply Capability

Without NBTI induced degradations, $I_{max}=NI_{pMOS}$, where $I_{pMOS}$ is the maximum output current of a single pMOS stage. For the DLDO, $|V_{gs}|$ in Equation (1) is equal to $V_{in}$ when $M_i$ is active. The pMOS transistor $M_i$ operates in linear region when turned on and the on-resistance $R_{on}$ of a single pMOS stage can be approximated as:

$$R_{on} \approx [(W/L)\mu_p C_{ox}(V_{in} - |V_{th}|)]^{-1} \tag{2}$$

where W, L, $\mu_p$, and $C_{ox}$ are, respectively, the width, length, mobility, and oxide capacitance of $M_i$, $I_{pMOS}$ can thus be expressed as:

$$I_{pMOS} = \frac{V_{sd}}{R_{on}} = (V_{in} - V_{out})(W/L)\mu_p C_{ox}(V_{in} - |V_{th}|) \tag{3}$$

where $V_{sd}$ is the source drain voltage of $M_i$. NBTI induced degradation factor $DF_i$ for $M_i$ can be defined as:

$$DF_i = \frac{I_{pMOS_i}^{deg}}{I_{pMOS}} = \frac{V_{in} - |V_{th}| - \Delta V_{th_i}}{V_{in} - |V_{th}|} \tag{4}$$

where $\Delta V_{th_i}$ and $I_{pMOS_i}^{deg}$ are, respectively, NBTI induced $V_{th}$ degradation and the degraded $I_{pMOS}$ for $M_i$. Degraded $I_{max}$ can be expressed as:

$$I_{max}^{deg} = I_{pMOS}\Sigma_{i=1}^{N} DF_i. \tag{5}$$

Figure 4:
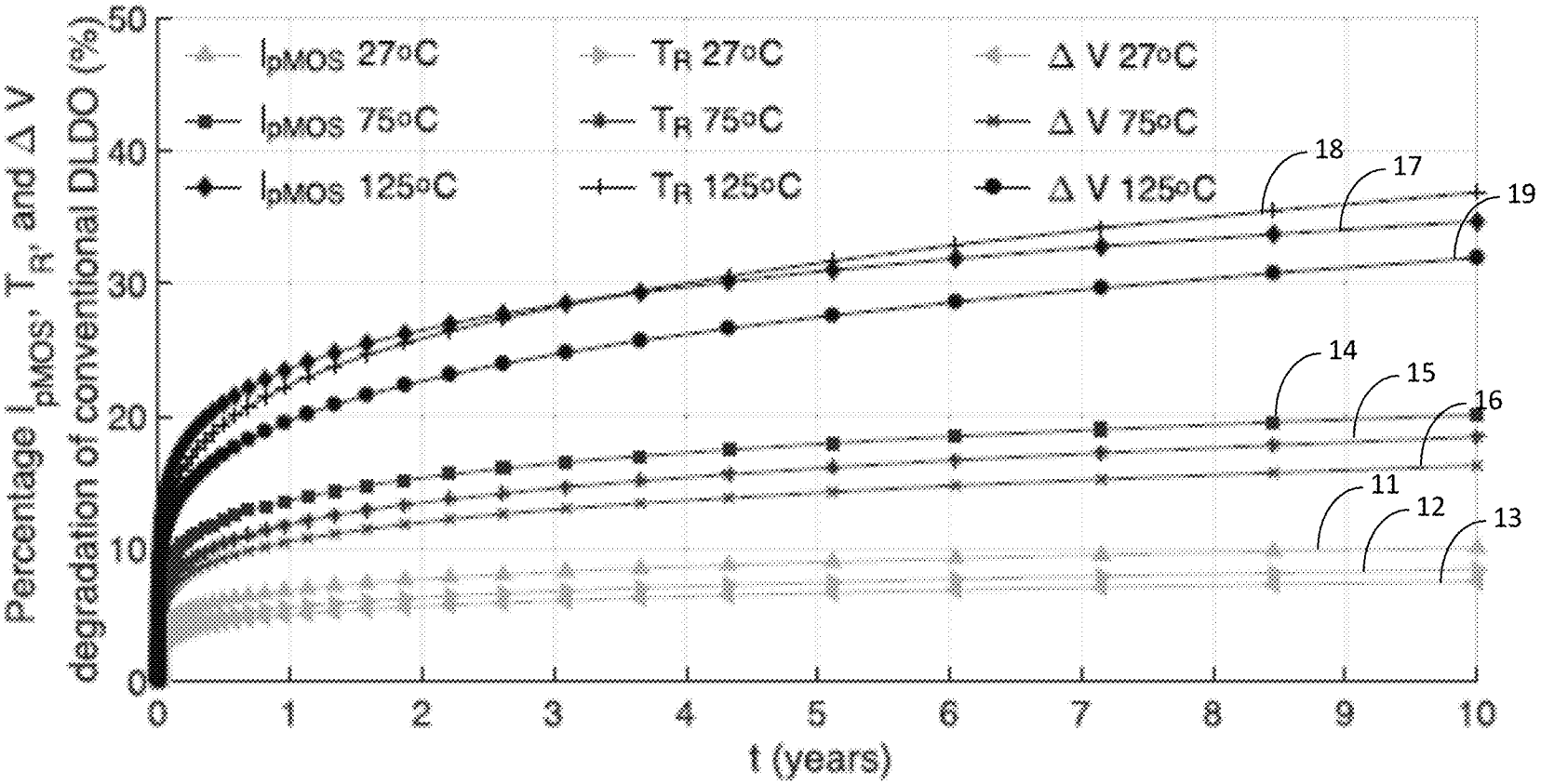
FIG. 4 is a graph showing the percentage of $I_{pMOS}$ degradation over time of a DLDO of the type shown in FIG. 1 that uses a bi-directional shift register of the type shown in FIG. 2.

FIG. 4 is a plot showing percentage $I_{pMOS}$, $T_R$, and ΔV degradation for bDSR-based DLDOs of the type shown in FIG. 1 for different temperature. Curves 11-13 correspond to $I_{pMOS}$, $T_R$ and ΔV, degradation, respectively, for 27° C. Curves 14-16 correspond to $I_{pMOS}$, $T_R$ and ΔV, degradation, respectively, for 75° C. Curves 17-19 correspond to $I_{pMOS}$, $T_R$ and ΔV, degradation, respectively, for 125° C. As an example, the percentage $I_{pMOS}$ degradation $1-DF_i$ for a smaller value of i, considering $M_i$ is active most of the time, is shown in FIG. 4 as a function of time under different temperatures. Equations (1) and (4) are leveraged for evaluation, where transistor model parameters are adopted from a 32-nm metal gate, high-k strained-Si CMOS technology within the predictive technology model (PTM) model library. A supply voltage $V_{in}$=1.1 V is used for estimation. PTM is adopted for the aging-induced deterioration analysis and subsequent DLDO simulations as it is widely used for BTI study due to the availability of fitting parameter values in the $\Delta V_{th}$ degradation model. As shown in FIG. 4, NBTI can induce significant $I_{pMOS}$ degradations, especially at high temperatures. Also, most degradation occurs in the first two years. Beyond two years, the degradation typically plateaus to within 10%. Degraded $I_{pMOS}$ can further lead to reduced $I_{max}$ and lower output voltage regulation capability under high load current. Moreover, as discussed in Sections II-B and II-C, degraded $I_{pMOS}$ also exacerbates $T_R$ and ΔV, necessitating reliability enhancement techniques.

B. Load Response Time

Load response time $T_R$ measures how fast the feedback loop responds to a step load. $T_R$ can be estimated as:

$$T_R = RC\ln\left(1 + \frac{\Delta i_{load}}{I_{pMOS} f_{clk} RC}\right) \tag{6}$$

where R, C, $f_{clk}$, and $\Delta i_{load}$ are, respectively, the average DLDO output resistance before and after $\Delta i_{load}$, capacitance, clock frequency, and amplitude of the load change. Considering NBTI effect, degraded $T_R$ can be expressed as:

$$T_R^{deg} = RCln\left(1 + \frac{\Delta i_{load}}{DFI_{pMOS} f_{clk} RC}\right). \tag{7}$$

As 0<DF<1 and $T_R<T_R^{deg}$, NBTI induced degradation slows down DLDO response.

C. Magnitude of the Droop

Magnitude of the droop ΔV reflects the $V_{out}$ noise profile under transient response and can be estimated as:

$$\Delta V = R\Delta i_{load} - I_{pMOS} f_{clk} R^2 Cln\left(1 + \frac{\Delta i_{load}}{I_{pMOS} f_{clk} RC}\right). \tag{8}$$

Considering NBTI effect, degraded ΔV can be expressed as:

$$\Delta V_{deg} = R\Delta i_{load} - DFI_{pMOS} f_{clk} R^2 Cln\left(1 + \frac{\Delta i_{load}}{DFI_{pMOS} f_{clk} RC}\right). \tag{9}$$

Let $\Delta i_{load}/I_{pMOS}f_{clk}RC=A$, A>0. Under 0<DF<1, the following holds:

$$1 + A > \left(1 + \frac{A}{DF}\right)^{DF} \tag{10}$$

$$I_{pMOS} f_{clk} R^2 Cln\left(1 + \frac{\Delta i_{load}}{I_{pMOS} f_{clk} RC}\right) > DFI_{pMOS} f_{clk} R^2 Cln\left(1 + \frac{\Delta i_{load}}{DFI_{pMOS} f_{clk} RC}\right) \tag{11}$$

and $\Delta V<\Delta V_{deg}$, which means NBTI can degrade the transient voltage noise profile.

D. Limit Cycle Oscillation

In the conventional DLDOs, when the shift register turns ON/OFF the pass transistor, the output voltage of the DLDO cannot change instantaneously due to the output pole of the DLDO. The delay between the operation of the shift register and fluctuation of the output voltage, together with the quantization effects of the comparator and the delay between the sampling instant and the time of pMOS array actuation lead to the occurrence of LCO. Such behavior can be examined by a nonlinear sampled feedback model to determine the possible modes and amplitudes of LCOs.

Figure 5:
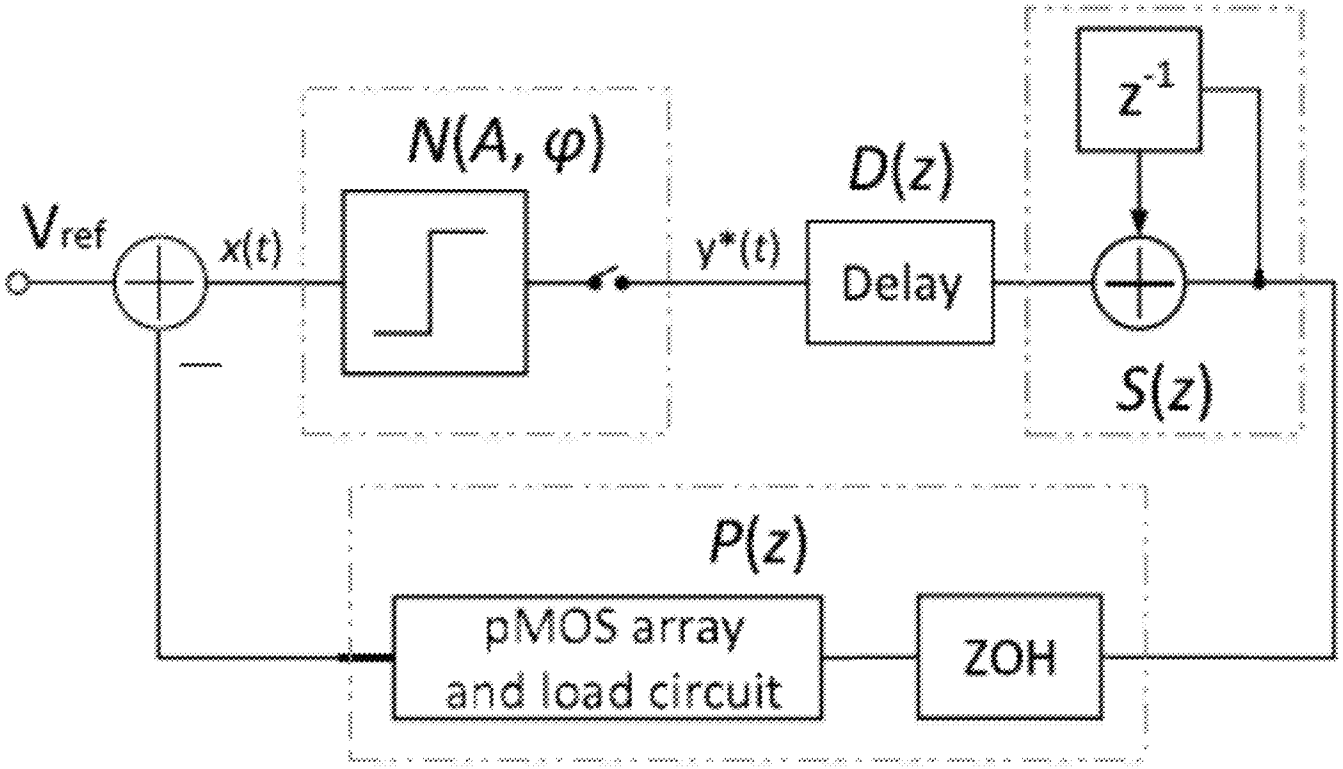
FIG. 5 (Prior Art)
FIG. 5 is a block diagram of a known nonlinear sampled feedback model.

FIG. 5 shows a block diagram of a nonlinear sampled feedback model developed by S. B. Nasir and A. Raychowdhury and published in "On limit cycle oscillations in discrete-time digital linear regulators," in Proc. IEEE APEC, March 2015, pp. 371-376. In the model, N(A,ϕ), P(z), S(z), and D(z) represent, respectively, the describing function of the clocked comparator, transfer function of the zero-order hold together with the pMOS array and load circuit, transfer function of the shift register, and delay element between the comparator and shift register. In FIG. 5, A and ϕ stand for the LCO amplitude and the phase shift of x(t), respectively.

N(A,ϕ), P(z), S(z), and D(z) can be expressed, respectively, as:

$$N(A, \varphi) = \frac{2D}{MTA}\sum_{m=0}^{M-1} \sin\left(\frac{\pi}{2M} + \frac{m\pi}{M}\right) L\left(\frac{\pi}{2M} - \varphi\right) \tag{12}$$

$$P(z) = K_{OUT}\frac{1 - e^{-F_l T}}{F_l(z - e^{-F_l T})} \tag{13}$$

$$S(z) = \frac{z}{z-1} \tag{14}$$

$$D(z) = z^{-1} \tag{15}$$

where $K_{OUT}=K_{dc}I_{pMOS}$, $T=1/f_{clk}$, $F_l=1/(R_L\|R_{pMOS})C$, and $\phi\in(0, \pi/M)$. D, $F_l$, $K_{OUT}$, $K_{dc}$, $R_L$, and $R_{pMOS}$ are, respectively, the amplitude of comparator output, load pole, gain of P(z), direct current (dc) proportional constant, load resistance, and resistance of power transistor array.

The mode and amplitude of LCO can be determined by the following Nyquist criterion:

$$N(A,\varphi)P(e^{j\omega T})S(e^{j\omega T})D(e^{j\omega T})=1\angle(-\pi) \tag{16}$$

where $\omega=\pi/TM$ is the angular LCO frequency. The phase shift ϕLCO for a steady LCO can thus be expressed as:

$$\varphi_{LCO} = \frac{\pi}{2} - \frac{\pi}{2M} - \tan^{-1}\left(\frac{\pi}{MTF_l}\right). \tag{17}$$

$\phi_{LCO}$ needs to be within (0, π/M) for mode M to exist.

Transistor aging can lead to increased path delay. Considering BTI-induced propagation delay degradation of the clocked comparator and shift register, the delay element in FIG. 5 becomes:

$$D'(z) = z^{-1}z^{-\frac{t_c^d}{T}}z^{-\frac{(t_s^d - t_c^d)}{T}} = z^{-1-\frac{t_s^d}{T}} \tag{18}$$

where $t_c^d$ and $t_s^d$ are, respectively, the degraded propagation delay of the clocked comparator and of the shift register. It should be noted that $t_c^d$ is canceled out in D'(z), and thus, the propagation delay of the clocked comparator has negligible effects on the mode of LCO. $\phi_{LCO}$ then becomes:

$$\varphi'_{LCO} = \frac{\pi}{2} - \frac{\pi}{2M} - \tan^{-1}\left(\frac{\pi}{MTF_l}\right) - \frac{\pi t_s^d}{MT}. \tag{19}$$

The negative effect of the propagation delay of the shift register on LCO can be explained as follows. If an LCO mode $M_a$ exists and the propagation delay of the shift register is not considered, the phase shift $\phi_{LCO}$ is within (0, $\pi/M_a$). That is, $0<\pi/2-\pi/2M_{as}-\tan^{-1}(\pi/M_aTF_l)<\pi/M_a$. For a larger LCO mode, $M_a+1$, to exist, the following condition needs to be satisfied:

$$0 < \frac{\pi}{2} - \frac{\pi}{2(M_a+1)} - \tan^{-1}\left(\frac{\pi}{(M_a+1)TF_l}\right) < \pi/(M_a+1) \tag{20}$$

Typically $$\frac{\pi}{2} - \frac{\pi}{2(M_a+1)} - \tan^{-1}\left(\frac{\pi}{(M_a+1)TF_l}\right) > \frac{\pi}{2} - \frac{\pi}{2M_a} - \tan^{-1}\left(\frac{\pi}{M_aTF_l}\right) \tag{21}$$

and if $\pi/2-\pi/2M_a-\tan-1(\pi/M_aTF_l)$ is very close to $\pi/M_a$, it is likely that:

$$\varphi_{LCO}|_{M=M_a+1} = \frac{\pi}{2} - \frac{\pi}{2(M_a+1)} - \tan^{-1}\left(\frac{\pi}{(M_a+1)TF_l}\right) > \pi/M_a > \pi/(M_a+1) \quad (22)$$

such that LCO mode Ma+1 cannot exist as (20) is violated.

However, if the propagation delay of the shift register is included, for LCO mode $M_a+1$, $\phi_{LCO}$ becomes:

$$\varphi'_{LCO}|_{M=M_a+1} = \frac{\pi}{2} - \frac{\pi}{2(M_a+1)} - \tan^{-1}\left(\frac{\pi}{(M_a+1)TF_l}\right) - \frac{\pi t_s^d}{(M_a+1)T} \quad (23)$$

The contribution of the $\pi t_x^d/(M_a+1)T$ term may push $\varphi'_{LCO}|M=M_a+1$ to be within the range of $(0, \pi/(M_a+1))$, making a larger LCO mode $M_a+1$ possible. This demonstrates the potential negative effect of the propagation delay of the shift register on LCO.

It should be noted that aging-induced propagation delay degradation is not a sufficient condition to incite a larger LCO mode. However, as will be discussed below in Sections III and IV, due to a small aging-induced shift register delay degradation, the lower boundary of the timing constraint for normal DLDO operation can be significantly smaller than half of the clock cycle such that beneficial effects of the reduced clock pulsewidth scheme can be achieved.

Section III. Aging-Aware (A-A) DLDO

Figure 6:
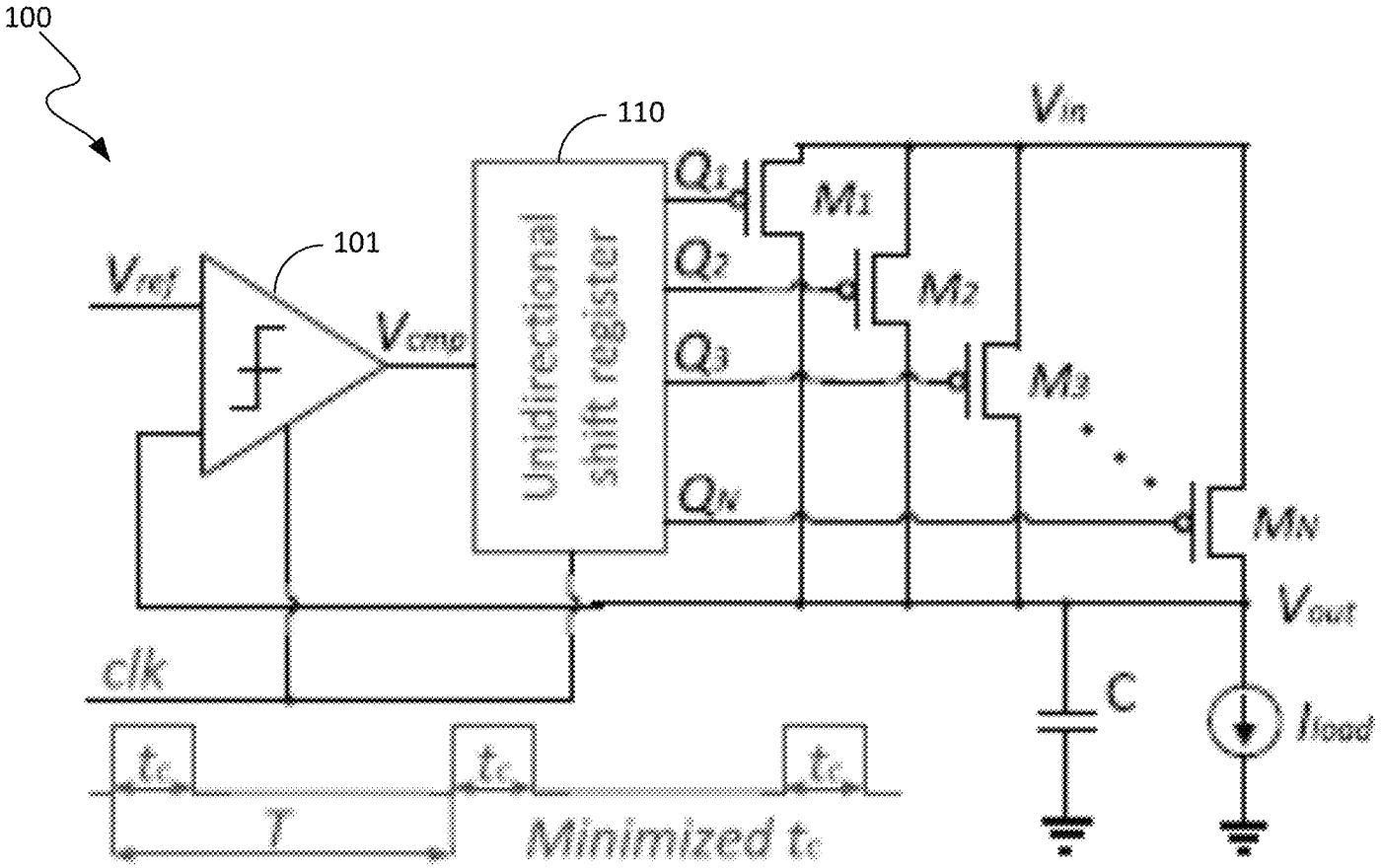
FIG. 6 is a schematic diagram of an aging-aware DLDO in accordance with a representative embodiment.

Considering the side effects of power transistor array and control loop degradations, a representative embodiment of an A-A DLDO 100 is shown in FIG. 6. The A-A DLDO 100 employs a unidirectional shift register (uDSR) 110 and reduced clock pulsewidth triggering to mitigate, respectively, $I_{pMOS}$, $T_R$, and $\Delta V$ degradation and LCOs. The uDSR 110 and reduced clock pulsewidth triggering are described below in detail explained in sections III-A and III-B, respectively. Power and area OH of the proposed techniques as well as compatibility analysis are provided in Section III-C.

N parallel pMOS power transistors $M_i$ (i=1, . . . , N) of the DLDO 100 are connected between the input voltage $V_{in}$ and output voltage $V_{out}$, and a feedback control loop is implemented with a clocked comparator 101 and the uDSR 110, which operates as the digital controller of the DLDO 100. The value of $V_{out}$ and reference voltage $V_{ref}$ are compared through the comparator 101 at the rising edge of the clock signal clk. The power transistors $M_i$ are turned on or off in the manner described below with reference to FIGS. 7 and 8.

A. Unidirectional Shift Register

To mitigate NBTI-induced $I_{pMOS}$, $T_R$ and $\Delta V$ degradations, distributing the electrical stress among all available power transistors as evenly as possible under arbitrary load current conditions is desirable. Reliability is not considered in conventional bDSR-based DLDO designs, and therefore too much stress is exerted on a small portion of $M_i$s. A representative embodiment of the uDSR is disclosed herein that evenly distributes the electrical stress among all of the $M_i$s to realize an A-A DLDO with enhanced reliability.

Figure 2:
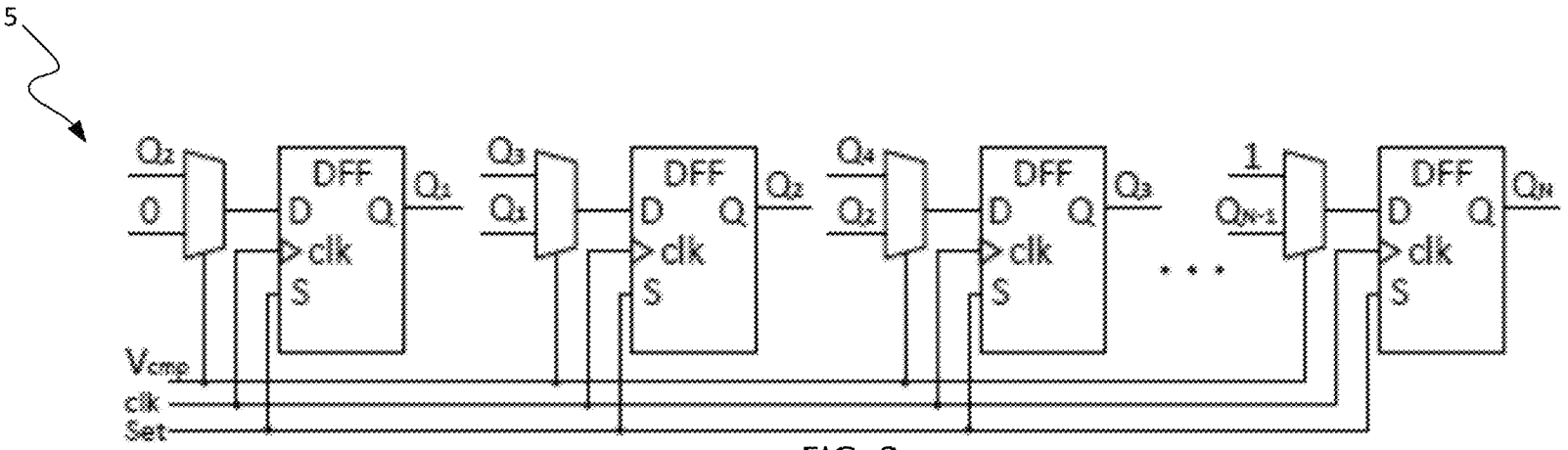
FIG. 2 (PRIOR ART)
FIG. 2 is a bi-directional shift register comprising the digital controller of the conventional DLDO shown in FIG. 1.
Figure 3:
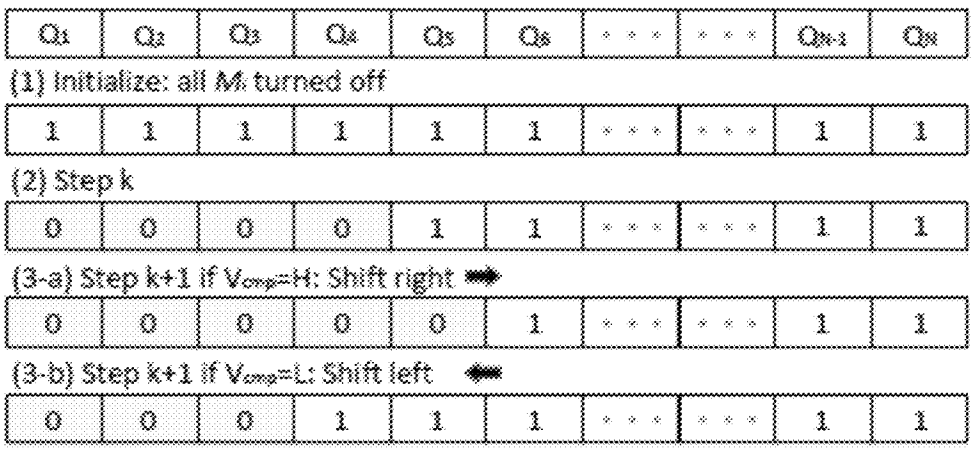
FIG. 3 (PRIOR ART)
FIG. 3 is a diagram showing the operation of the bi-directional shift register shown in FIG. 2.
Figure 7:
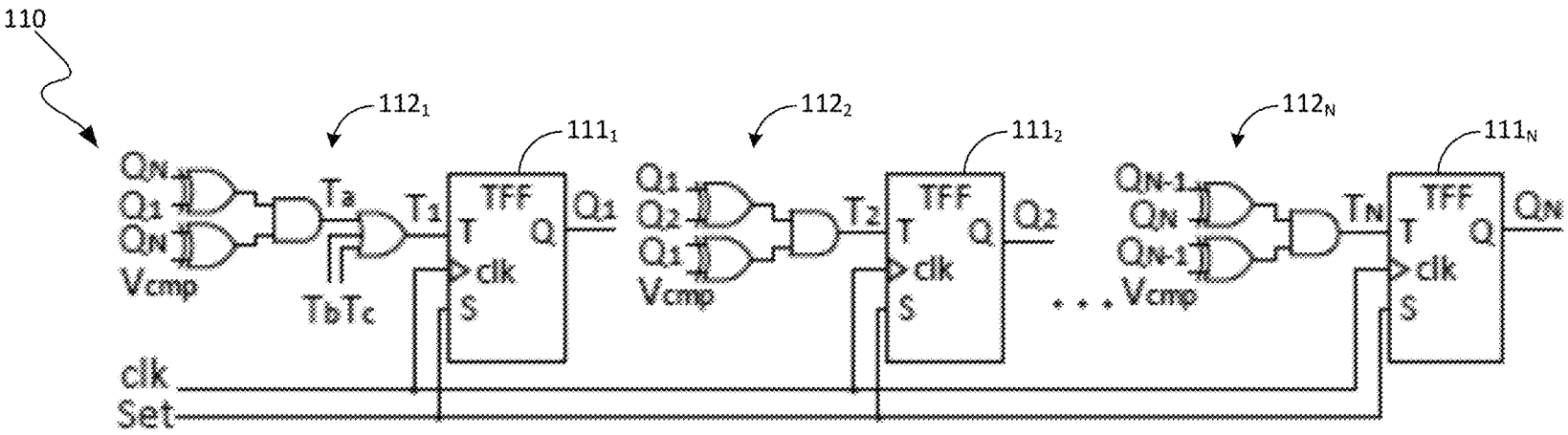
FIG. 7 is a schematic diagram of a uni-directional shift register of the aging-aware DLDO shown in FIG. 6 in accordance with a representative embodiment.
Figure 8:
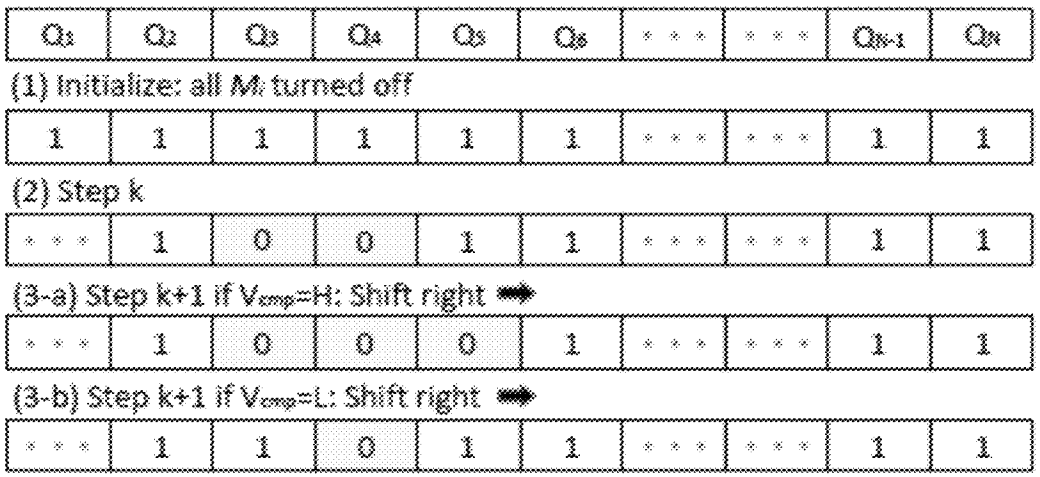
FIG. 8 is a diagram showing the operation of the uni-directional shift register shown in FIG. 7 in accordance with a representative embodiment.

FIG. 7 shows a schematic diagram of the uDSR 110 in accordance with a representative embodiment. FIG. 8 is a diagram showing the manner in which the uDSR 110 operates in accordance with a representative embodiment. In accordance with this representative embodiment, the elementary D flip-flops (DFFs) and the multiplexer within the bDSR shown in FIG. 2 are replaced with T flip-flops (TFFs) $\mathbf{111}_1$-$\mathbf{111}_N$ and a simple combination of logic gates $\mathbf{112}_1$-$\mathbf{112}_N$ within the uDSR 110, respectively. The rest of the DLDO 100, including the parallel power transistors $M_i$s and the clocked comparator 101 can remain unchanged. One of the objectives here is to balance the utilization of each available $M_i$ under all load current conditions. To achieve this objective, control signals $Q_{i-1}$ and $Q_i$ for two adjacent power transistors $M_{i-1}$ and $M_i$, respectively, are XORed to determine if $M_{i-1}$ and $M_i$ are at the boundary of active and inactive power transistor portions. Normally, there are two such boundaries if at least one power transistor is active, as shown in FIG. 8. $Q_{i-1}$ and output of the comparator $V_{cmp}$ are thus XORed by the combinations of logic gates $\mathbf{112}_1$-$\mathbf{112}_N$ to decide which power transistor at the boundaries needs to be turned on/off at the rising edge of the clock signal.

An inactive power transistor at the right boundary is turned on if $V_{cmp}$ is logic high. An active power transistor at the left boundary is turned off if $V_{cmp}$ is logic low. The uDSR 110 is realized through this activation/deactivation scheme, as demonstrated in FIG. 8. $Q_{i-1}$ for the first stage is $Q_N$ from the last stage and thus a loop is formed. Considering the initialization step when all $M_i$s are off and the full load current condition when all $M_i$s are on, additional control signals are inserted as $T_b$ and $T_c$ in the first stage at the combination of logic gates $\mathbf{112}_1$, to avoid inaction under these two situations, where $T_b=Q_1 \cdot Q_2 \ldots Q_N \cdot V_{cmp}$ and $T_c=\overline{Q_1+Q_2+\ldots+Q_N+V_{cmp}}$. The logic functions for $T_b$ and $T_c$ can be implemented with n-input AND/NOR gates, for example, as shown in FIG. 7, although other logic gate configurations could be used for this purpose.

Considering the similar area of DFF and TFF, the proposed uDSR only induces ~3.8% area overhead per control stage compared to bDSR. The total area overhead is thus ~2.6% of a single DLDO area designed with μA current supply capability. As little extra transistors are added per control stage and the bDSR only consumes a few μW power, the uDSR induced power overhead is also negligible. With larger $I_{pMOS}$ for higher load current rating, both the area and power overhead can be significantly less.

1. Steady-State Operation

Under steady-state conditions, LCO occurs to supply the required current. The number of active power transistors changes dynamically at the rising edge of each clock cycle. Due to LCO, the changing number of active power transistors leads to the flip of control logics and power transistors for both conventional DLDOs and for the DLDO 100. The number of active/inactive power transistors is the same during each clock cycle for both the bDSR shown in FIG. 2 and for uDSR 110 control if all other simulation settings except the digital controller are the same. The only functional difference between the two controllers is which portion of the power transistor array is active during each clock cycle as illustrated in the following.

FIGS. 9 and 10 illustrate the different operations at steady state of the bDSR 5 shown in FIG. 2 and the uDSR 110 with LCO mode M=2 for simplicity. The LCO mode M indicates the number of switching power transistors for the conventional bDSR-based DLDO at steady state. With respect to FIG. 9, the operation of the bDSR 5 is as follows. Assuming at step k (rising edge of the kth clock cycle) power transistors M1 and M2 are active, due to mode 2 LCO and bDSR control (right shift with increasing number of active power transistor and left shift with decreasing number of active power transistor), power transistors M3 and M4 become active at, respectively, step k+1 and step k+2 (rising edge of the (k+1)th and (k+2)th clock cycle). Power transistors M4 and M3 become inactive at, respectively, step k+3 and step k+4. The subsequent steps will repeat steps k+1 to k+4.

With reference to FIG. 10, the operation of the uDSR 110 is as follows. Assuming at step k that power transistors M3 and M4 are active, due to mode 2 LCO and uDSR control (power transistor is always activated on the right side of the active power transistor region and deactivated on the left side of active power transistor region, i.e., the darkened region in FIG. 10), power transistors M5 and M6 become active at, respectively, step k+1 and step k+2. Power transistors M3 and M4 become inactive at, respectively, step k+3 and step k+4. The subsequent steps will follow the same activation/deactivation pattern. The location of the darkened region dynamically shifts right (unidirectional shift). For a long-term reliability concern, each $M_i$ is active for six clock cycles before it becomes inactive. When power transistor $M_N$ becomes active, the next activated power transistor will be $M_1$ such that a loop is formed and electrical stress can be more evenly distributed among all of the power transistors as compared to bDSR operation.

Figure 11:
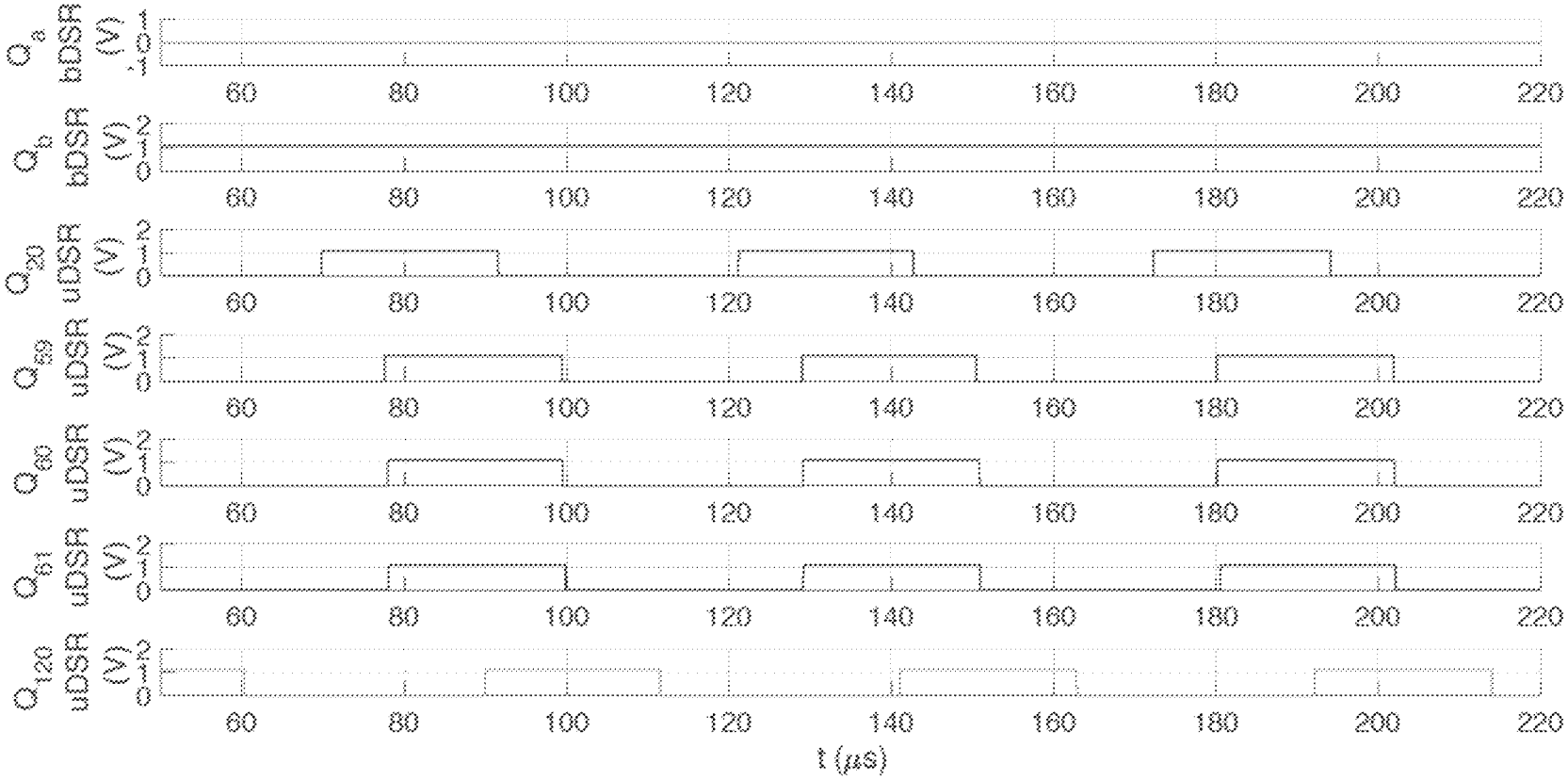
FIG. 11 is a diagram that represents simulated steady-state gate signals of power transistors with bDSR control as shown in FIG. 2 and with uDSR control as shown in FIG. 7, where $Q_a$ ($1 \le a < I_{load}N/I_{max} - M$) and $Q_b$ ($I_{load}N/I_{max} + M < b \le N$) are, respectively, gate signal of active power transistor $M_a$ and inactive power transistor $M_b$ with bDSR control.

FIG. 11 is a diagram that represents simulated steady-state gate signals of power transistors with bDSR and uDSR control, where $Q_a$ ($1 \le \alpha < I_{load}N/I_{max} - M$) and $Q_b$ ($I_{load}N/I_{max} + M < b \le N$) are, respectively, gate signal of active power transistor $M_a$ and inactive power transistor $M_b$ with bDSR control. $Q_i$s ($1 \le i \le N$) all have similar waveforms with uDSR control. For the simulations shown in FIG. 11, $I_{load}$=300 mA. The detailed design specifications for the DLDO 100 are described in Section IV-A. As shown in FIG. 11, for bDSR control, power transistor $M_a$s experience electrical stress all of the time while power transistors $M_b$s are always OFF. For uDSR control, three randomly picked adjacent power transistor gate signals $Q_{59}$, $Q_{60}$, and $Q_{61}$ together with two additional further separated gate signals $Q_{20}$ and $Q_{120}$ are demonstrated. The falling edge of $Q_{60}$ ($Q_{61}$) demonstrates delay as compared to $Q_{59}$ ($Q_{60}$). However, the percentage of time when power transistor $M_i$ ($1 \le i \le N$) is active is the same for all $M_i$s, and thus, the electrical stress can be more evenly distributed.

2. Transient Load Operation

Under transient load conditions, operations of the bDSR and uDSR follow similar activation/deactivation patterns to those demonstrated in FIGS. 9 and 10, respectively. If Vout<Vref (Vout>Vref) due to increased (decreased) load current, for bDSR, inactive (active) power transistors at the right boundary of the darkened region in FIG. 9 are gradually turned ON (OFF) to supply the required output current and regulate $V_{out}$. The darkened region always locates at the left side of the power transistor array. In contrast, for uDSR oeprations, inactive (active) power transistors at the right (left) boundary in FIG. 10 are gradually turned ON (OFF) and the darkened region dynamically moves right at all times, leading to a more balanced distribution of electrical stress.

Figure 12:
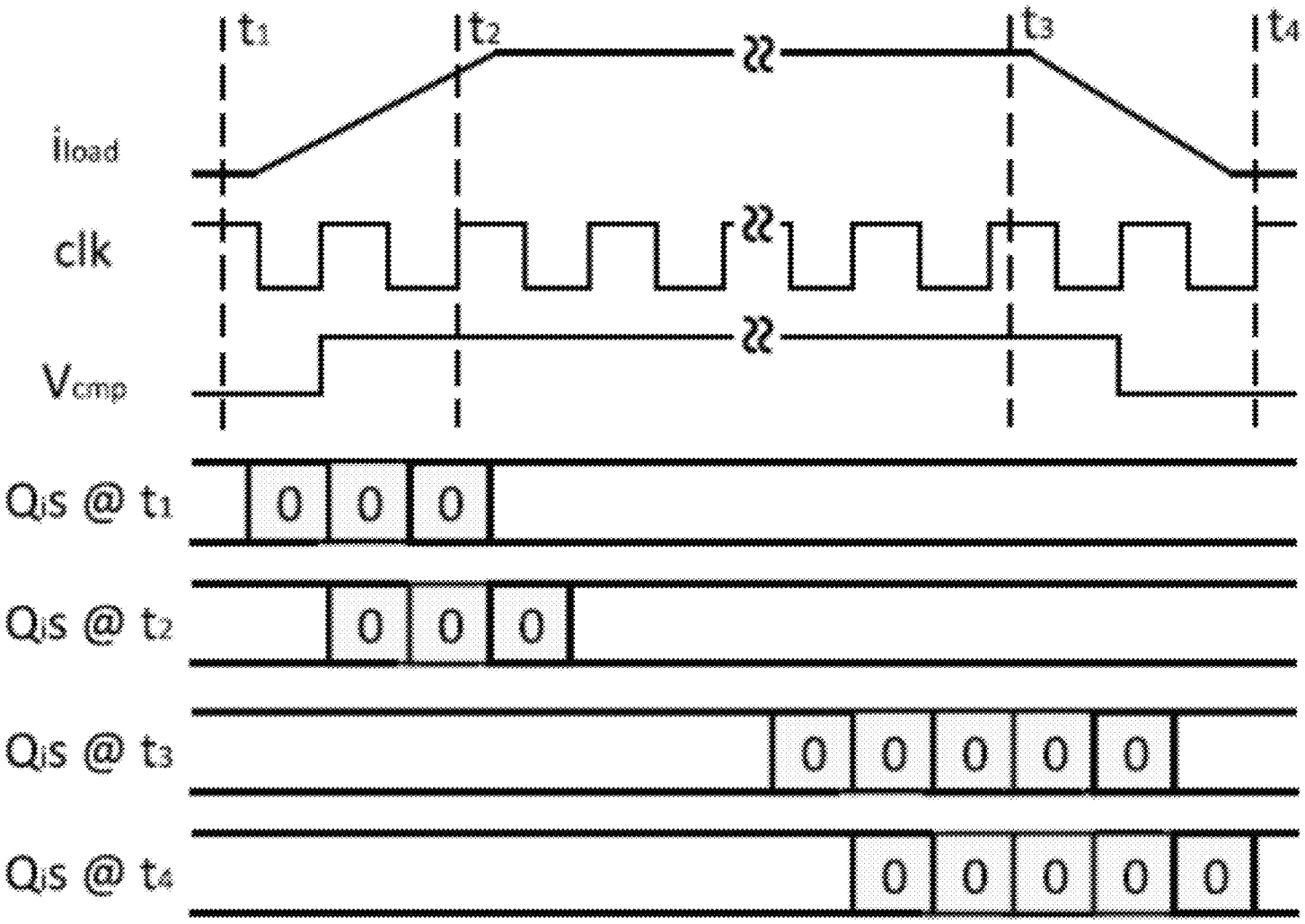
FIG. 12 is a timing diagram that conceptually illustrates transient waveforms and active power transistor locations for the DLDO shown in FIG. 6.

FIG. 12 is a timing diagram that conceptually illustrates transient waveforms and active power transistor locations for the DLDO 100. The operation of uDSR 110 under transient load conditions will be elaborated on with reference to FIG. 12. A step load current with a few clock cycles of rise and fall time is utilized for illustration. Assume at t1 before the load increase, there are three active power transistors on the left side of the power transistor array, the deactivation of power transistor at the left boundary at the next clock rising edge, and the activation of power transistor at the right boundary at the following clock rising edge lead to the updated active power transistor locations at t2. The number of active power transistors continues to increase after t2 and due to the steady-state operation of the uDSR following FIG. 10, active power transistors with an increased number move right to reach the new locations at t3. After experiencing one more activation and deactivation of power transistors due to load decrease, the updated locations at t4 (the second clock rising edge after t3) are demonstrated at the bottom in FIG. 12.

Thus, regardless of the load current conditions, electrical stress can always be more evenly distributed among all of the available power transistors of the DLDO 100. Furthermore, as compared to the conventional bDSR-based DLDO 2, the number of activated/deactivated power transistors per clock cycle remains the same, and thus, bDSR and uDSR have the same transfer function S(z). Leveraging uDSR to evenly distribute electrical stress within the power transistor array does not negatively affect control loop performance.

B. Reduced Clock Pulsewidth

Figure 13:
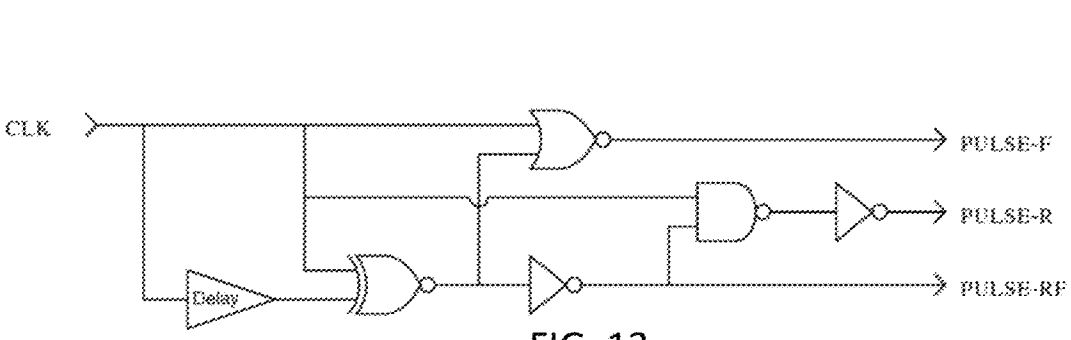
FIG. 13 (Prior Art)
FIG. 13 is a block diagram of a known one-shot pulse generator that may be used as a clock puslewidth reduction circuit in combination with the DLDO shown in FIG. 6 or with a conventional DLDO of the type shown in FIG. 1 for mitigating performance degradation associated with LCO.
Figure 14:
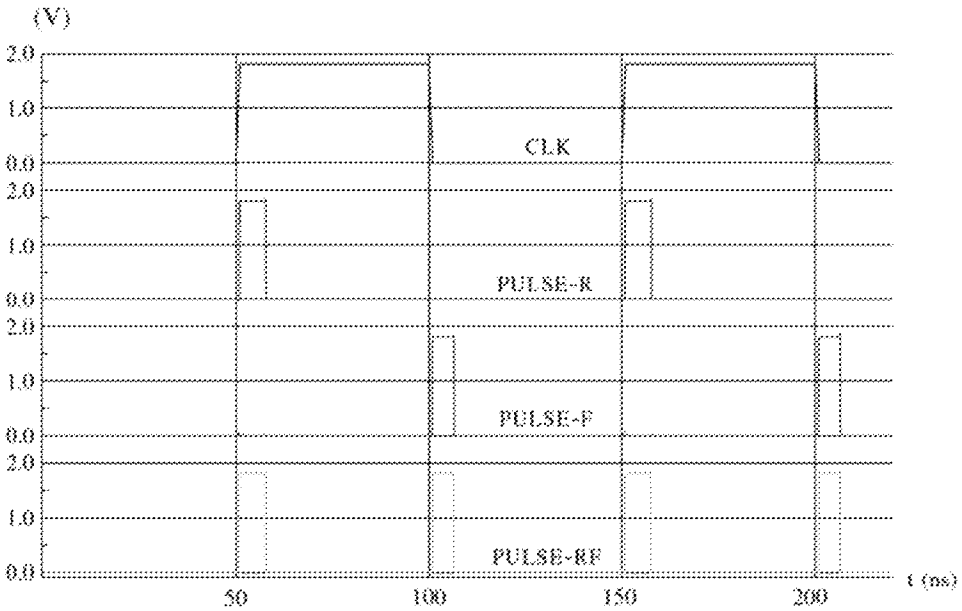
FIG. 14 (Prior Art)
FIG. 14 is a timing circuit for the one-shot pulse generator shown in FIG. 13.

The clock signal that is typically used with the DLDOs of the type shown in FIG. 1 has a 50% duty cycle and is a standard clock signal generated by a common clock generation circuit. DLDOs are used to power various load circuits and the standard clock signal is used by the load circuits as well. It is known to employ dual-clock edge triggering in a DLDO to reduce the control signal delay, where the clocked comparator and shift register are triggered at the rising and falling edges of the clock signal, respectively. In accordance with a representative embodiment, considering the potential side effect of the control loop delay element D'(z) on LCO as discussed in Section II-D, a reduced clock pulsewidth $t_c$, as shown in FIG. 6, preferably is used to minimize the delay element. With dual-clock edge-triggering implementation of the control loop of the present disclosure, the following condition needs to be satisfied regarding tc for proper operation of the uDSR-based DLDO:

$$t_c > t_c^d + t_l^d + t_t^{st} \tag{24}$$

where $t_l^d$ and $t_t^{st}$ are, respectively, the total propagation delay of the logic gates $\mathbf{112}_1$ connected to the first stage TFF $\mathbf{111}_1$ within the uDSR 110 and the setup time of the TFF $\mathbf{111}_1$. Aging-induced degradation of $t_l^d$, $t_t^{st}$ and $t_c^d$, needs to be considered with the targeted lifetime to decide the value of $t_c$. A known one-shot pulse generator can be leveraged for reduced pulsewidth clock generation. For example, FIG. 13 is a block diagram of a one-shot pulse generator 120 described in an article by V. R. H. Lorentz et al., entitled "Lossless average inductor current sensor for CMOS integrated DC-DC converters operating at high frequencies," published in Analog Integr. Circuits Signal Process., vol. 62, no. 3, pp. 333-344, 2009. FIG. 14 is a timing circuit for the one-shot pulse generator 120 shown in FIG. 13. The PULSE-R output signal of the one-shot pulse generator 120 will be used as the clock signal, clk, shown in FIG. 6 for clocking the comparator 101 and the uDSR 110. It can be seen in FIG. 14 that the PULSE-R output signal has the same cycle as the CLK signal that is input to the generator 120, with the rising edges of the PULSE-R signal and the CLK signal occurring at substantially the same instant in time. It can also be see in FIG. 14 that the pulsewidth of the PULSE-R output signal is only a small fraction of the pulsewidth of the CLK signal. It should be noted that the one-shot pulse generator of the type shown in FIG. 13 is one of multiple circuit configurations that can be used for reducing the clock pulsewidth. As will be understood by those of skill in the art, other clock pulsewidth reduction circuits may be used for this purpose.

The one-shot pulse generator 120 comprises a delay element 121, an XNOR gate 122, a first inverter 123, a NOR gate 124, a NAND gate 125, and a second inverter 126. When using the one-shot pulse generator 120 as the clock pulsewidth reduction circuit for the DLDO 100, the minimum pulsewidth of the PULSE-R signal is limited by the delay element 121 and the maximum pulse width is limited by the pulsewidth of the CLK signal. The PULSE-R signal that will be used as the clk signal of the DLDO 100 shown in FIG. 6 will have a pulsewidth that is less than 100% of the pulse width of CLK, and will ideally be as small as possible. The minimum pulsewidth of clk is limited by Eq. 24. If, for example, CLK is a 10 MHz clock signal, clk may have a 1 ns pulsewidth.

It should be noted that the clock pulsewidth reduction circuit is discussed herein in terms of its use with the DLDO 100 shown in FIG. 6 having the uDSR 110 shown in FIG. 7, the clock pulsewidth reduction circuit could be used beneficially with other types of DLDOs (e.g., DLDO 2 shown in FIG. 1) that use a bDSR (e.g., bDSR 5 shown in FIG. 2). The primary benefit of using the clock pulsewidth reduction circuit is improvement of the steady-state performance of the DLDO, and this benefit can be realized by other types of DLDOs that incorporate the clock pulsewidth reduction circuit (i.e., DLDOs other than the DLDO 100 shown in FIG. 6). Using the clock pulsewidth reduction circuit in combination with the DLDO 100 improves both steady-state and transient performance.

Within the A-A DLDO 100, $\phi_{LCO}$ becomes:

$$\varphi''_{LCO} = \frac{\pi}{2} + \frac{\pi}{2M} - \tan^{-1}\left(\frac{\pi}{MTF_l}\right) - \frac{\pi(t_s^d + t_c)}{MT} \tag{25}$$

The effectiveness of the DLDO 100 having a reduced clock pulsewidth DLDO regarding LCO mode reduction will be described below in Section IV-B.

C.1 Overhead

Considering the similar area of DFFs and TFFs, the uDSR 110 only induces ~3.8% area OH per control stage compared to the bDSR 5. The total area OH including the one-shot pulse generator is ~2.6% of a single active DLDO area designed with μA current supply capability. As few extra transistors are added per control stage and the bDSR 5 only consumes a few μW power, the uDSR-induced power OH is also negligible. With larger IpMOSs for higher load current rating, both the area and power OH can be significantly less. It should be noted that the area OH discussed here is different from the area OH that will be discussed in Section V to compensate aging-induced degradation.

C.2 Compatibility With Quiescent Current Saving Technique

In accordance with a representative embodiment, known freeze mode operation and clock gating techniques are employed in the DLDO 100 to save quiescent current at steady state. For freeze mode operation, the DLDO control circuit can be disabled once the number of active power transistors converges to save the quiescent current. In this case, the operation of the uDSR 110 would also be stopped. However, after many load current changes and different steady-state operations for long-term reliability concern, the active power transistor region (darkened region shown in FIG. 8) still moves rightward and electrical stress can also be more evenly distributed among all of the power transistors as compared to the conventional bidirectional shift method.

Furthermore, in accordance with an embodiment, a known sliding clock gating technique can also be utilized to save the steady-state quiescent current. For this purpose, the power transistor array and the control flip-flops are divided into multiple sections with equal number within each section. During steady-state operation, if the left boundary of the active power transistor region falls within one section and the right boundary falls within another section, other sections not covering the two boundaries can be temporarily clock gated to save quiescent current. The active power transistor region still dynamically moves rightward to evenly distribute the electrical stress and the clock-gated sections also dynamically change. For this case, as not all flip-flops are clock gated, the steady-state quiescent current can be higher than that in the freeze mode operation discussed earlier. Thus, the unidirectional shift scheme is still beneficial even when a steady-state quiescent current saving technique is employed. However, a tradeoff exists between the steady-state quiescent current saving and reliability enhancement enabled by the unidirectional shift scheme.

Section IV. Evaluation

To evaluate the benefits of the proposed AA DLDO architecture in terms of reliability enhancement and to provide design insights for a targeted lifetime, an IBM POWER8 like microprocessor simulation platform is constructed.

A.1 Simulation Framework

Figures 15, 16:
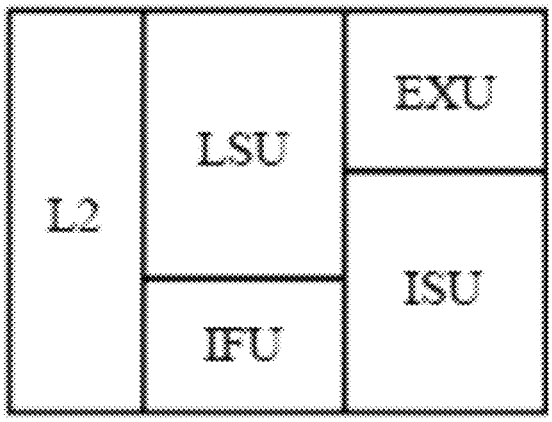
FIG. 15 is a table listing technology and architecture parameters for a simulation that was performed to demonstrate benefits of employing the uni-directional shift register configuration shown in FIG. 7 in a DLDO.
FIG. 16 is a schematic diagram of the functional blocks of one core within an IBM POWER8 like microprocessor chip used in the simulation defined by the architectural parameters listed in the table of FIG. 15.

An IBM POWER8 Like Microprocessor was used for the simulation framework. The IBM POWER8 microprocessor is currently among one of the state-of-the-art server-class processors and, thus, a representative for evaluation of the proposed A-A DLDO design scheme. FIG. 15 contains Table I, which lists the corresponding technology and architecture parameters. FIG. 16 is a block diagram of the IBM POWER8 like microprocessor core, which includes a load store unit (LSU), an execution unit (EXU), an instruction fetch unit (IFU), an instruction scheduling unit (ISU), an L1 data cache inside LSU, an L1 instruction cache inside IFU, and a private L2. All benchmarks are from SPALSH2× and cover a wide range of representative application domains. Analysis is restricted to the region of interest of the benchmarks and eight threads are involved in the simulations. Table II shown in FIG. 17 is a summary of the load characteristics of different functional blocks under all experimented benchmarks.

A.2 DLDO Design Specifications

Distributed microregulators are implemented in IBM POWER8 microprocessor. In this simulation example, a switch array of 256 pMOS transistors, which is typical in DLDO designs, is implemented in each microregulator. Two different DLDO designs with bDSR and uDSR controls are implemented using 32-nm PTM CMOS technology where $V_{in}$=1.1V and $V_{out}$=1V. In the simulation, $I_{pMOS}$=2 mA and $I_{max}$=512 mA are used, leading to 7, 24, 3, 10, and 5 microregulators (DLDOs) in the, respectively, IFU, LSU, ISU, EXU, and L2 blocks shown in FIG. 16 to be able to supply the maximum load current across all benchmarks in each block. Load current of each block is assumed to be supplied by microregulators within that block, which is reasonable due to the principle of spatial locality regarding current distribution. Each microregulator within a certain block is assumed to provide equal current due to the availability of current balancing scheme implemented within IBM POWER8 microprocessor. In the simulation, $f_{clk}$=10 MHz and C=15 nF are used for each DLDO to achieve smaller than 10% Vdd transient voltage noise most of the time. The total output capacitance is 735 nF. As resonant clock meshes are already deployed within IBM POWER8 processor, the complexity and OH of generating and distributing the clock signal for the DLDOs can be frequency dividers consisting of simple flip-flops and localized routing wires.

A.3 Evaluation of Aging-Induced Performance Degradation

Equations (1), (3), (6), and (8) are leveraged for the evaluation of aging-induced performance degradation. A typical temperature profile of 90° C., 69° C., 67° C., 63° C., and 62° C. for, respectively, LSU, EXU, IFU, ISU, and L 2 is adopted for evaluations. The activity factors for both DLDO designs under different benchmarks and functional blocks are estimated through simulations in Cadence Virtuoso. The worst case $I_{pMOS}$ degradations are used for evaluations of both designs, which is reasonable due to load characteristics of typical applications and the consequent heavy use of a portion of $M_i$s in conventional DLDOs.

B.1 Simulation Results: Performance Degradation Within Conventional DLDO

Table III shown in FIG. 17 lists a summary of the conventional DLDO performance degradation regarding $I_{pMOS}$, $T_R$, and ΔV for different functional blocks for a 5-year time frame. These degradations apply to all the experimented benchmarks as the worst case $I_{pMOS}$ degradation is considered. As shown in Table III, NBTI can induce serious $I_{pMOS}$, $T_R$, and ΔV degradations for all functional blocks. $I_{pMOS}$ degradation can lead to the deterioration of DLDO $V_{out}$ regulation capability and possible $V_{out}$ drop under large load current conditions. Larger than 10% $V_{out}$ drop can lead to voltage emergencies and potential execution errors for microprocessors. Similarly, $T_R$ and ΔV degradations can, respectively, increase the duration and frequency of voltage emergencies, which can slow down microprocessor executions as further actions may need to be taken to remedy the errors. Moreover, for a longer targeted lifetime of more than 5 years, the degradations are expected to be more disastrous, as $I_{pMOS}$ degradations are even worse, as seen from FIG. 4, which may not be tolerable for critical applications where the replacement of the devices can be costly or even impossible.

B.2 Simulation Results: $I_{pMOS}$, $T_R$, and ΔV Mitigation With The Aging-Aware DLDO Simulation results for all benchmarks for $I_{pMOS}$, $T_R$, and ΔV degradation mitigation of the uDSR-based DLDO 100 as compared to the conventional DLDO design for a 5-year time frame indicated up to 39.6%, 43.2%, and 42% performance improvement is achieved for, respectively, $I_{pMOS}$, $T_R$, and ΔV. The highest performance improvement is obtained for the LSU functional block with the highest operation temperature. Even at the lowest operation temperature within the L2 functional block, degradation mitigations of up to 15.1%, 16.4%, and 15.9% are achieved for, respectively, $I_{pMOS}$, $T_R$, and ΔV.

B.3 Simulation Results: LCO Mitigation With Aging-Aware DLDO

To verify the benefits of the DLDO 100 used in combination with the reduced clock pulsewidth generation circuit (e.g., one-shot pulse generator 120) regarding LCO mitigation, the theoretical maximum LCO mode for dual-edge-triggered and reduced clock pulsewidth DLDOs with the uDSR implementation is examined by considering BTI-induced threshold voltage degradation of the control loop. An average IBM POWER8 microprocessor temperature profile of 70° C. is utilized for $V_{th}$ degradation evaluation. NBTI and PBTI are considered as the major $V_{th}$ degradation factor for pMOS and nMOS transistors in the control loop, respectively. Under different load current conditions, the activity factor of each transistor within the control loop is obtained through simulations in Cadence Virtuoso. Equation (1) is then leveraged to calculate the $V_{th}$ degradation for each transistor within a 5-year time frame. The calculated $V_{th}$ degradation is embedded in each transistor by adopting a known subcircuit model for BTI effect within Cadence Virtuoso simulations.

FIG. 19 is a table summarizing the fresh and aged TFF setup time $t^{st}_t$, logic delay $t^d_l$, and comparator delay $t^d_c$ obtained during the simulation of the A-A DLDO having the design showin in FIG. 6 using the reduced clock pulsewidth circuitry of the type shown in FIG. 13. The aged $t^{st}_t$, $t^d_l$, and $t^d_c$ are approximately load current independent.

Figure 20:
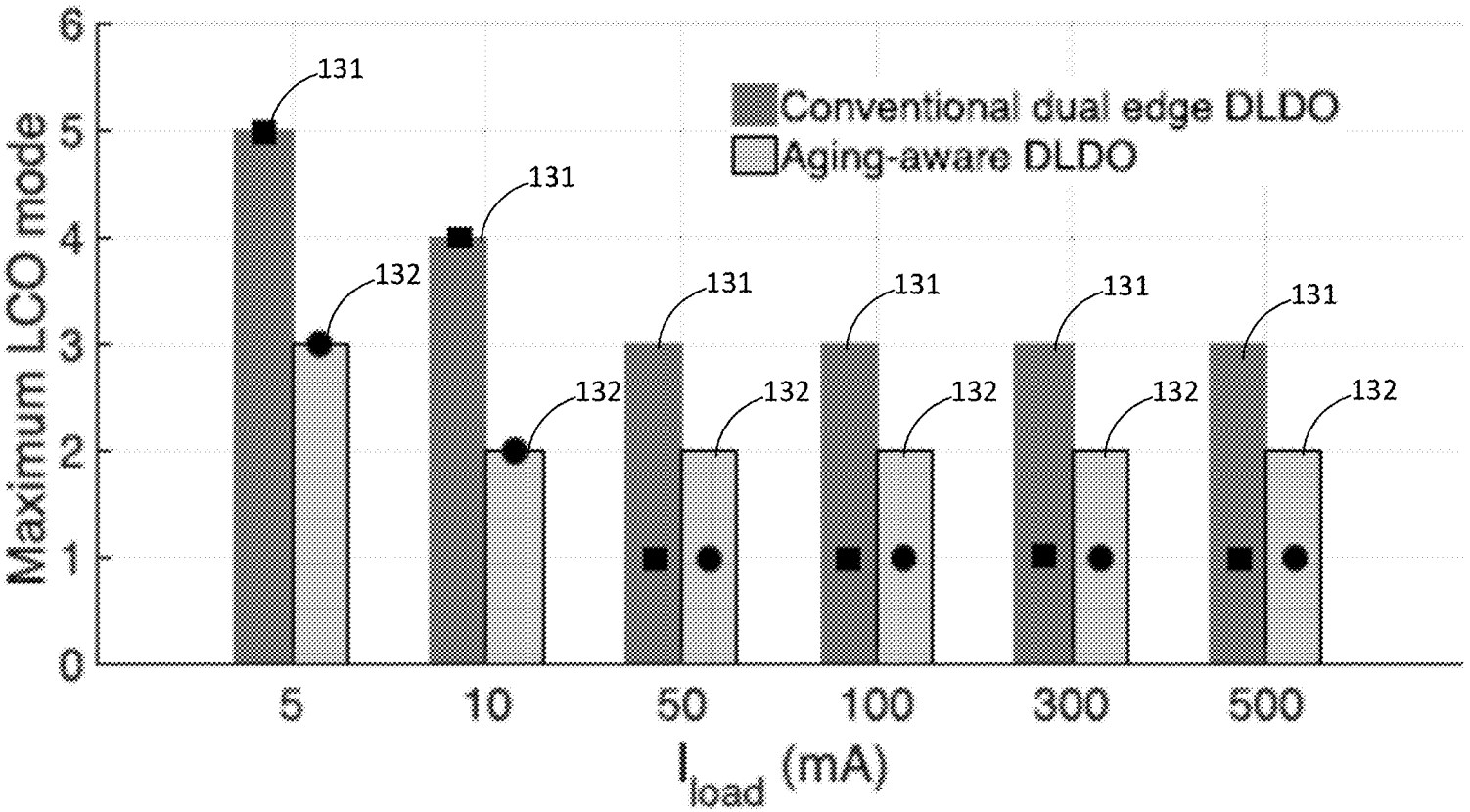
FIG. 20 is a graph showing maximum LCO mode with simulation results superimposed for the conventional DLDO having the design shown in FIG. 1 and the A-A DLDO having the design shown in FIG. 6 employing the reduced clock pulsewidth circuitry of the type shown in FIG. 13 under different load current conditions after a 5-year aging period.

FIG. 20 is a graph showing maximum LCO mode with simulation results superimposed for the conventional DLDO (bars 131) having the design shown in FIG. 1 and the A-A DLDO (bars 132) having the design shown in FIG. 6 employing the reduced clock pulsewidth circuitry of the type shown in FIG. 13 under different load current conditions after a 5-year aging period. As seen from FIG. 20 by comparing the heights of the bars 131 and 132, with reduced clock pulsewidth, considering aging imposed limitations, the maximum LCO mode can be greatly reduced, especially under light-load conditions.

Figure 21:
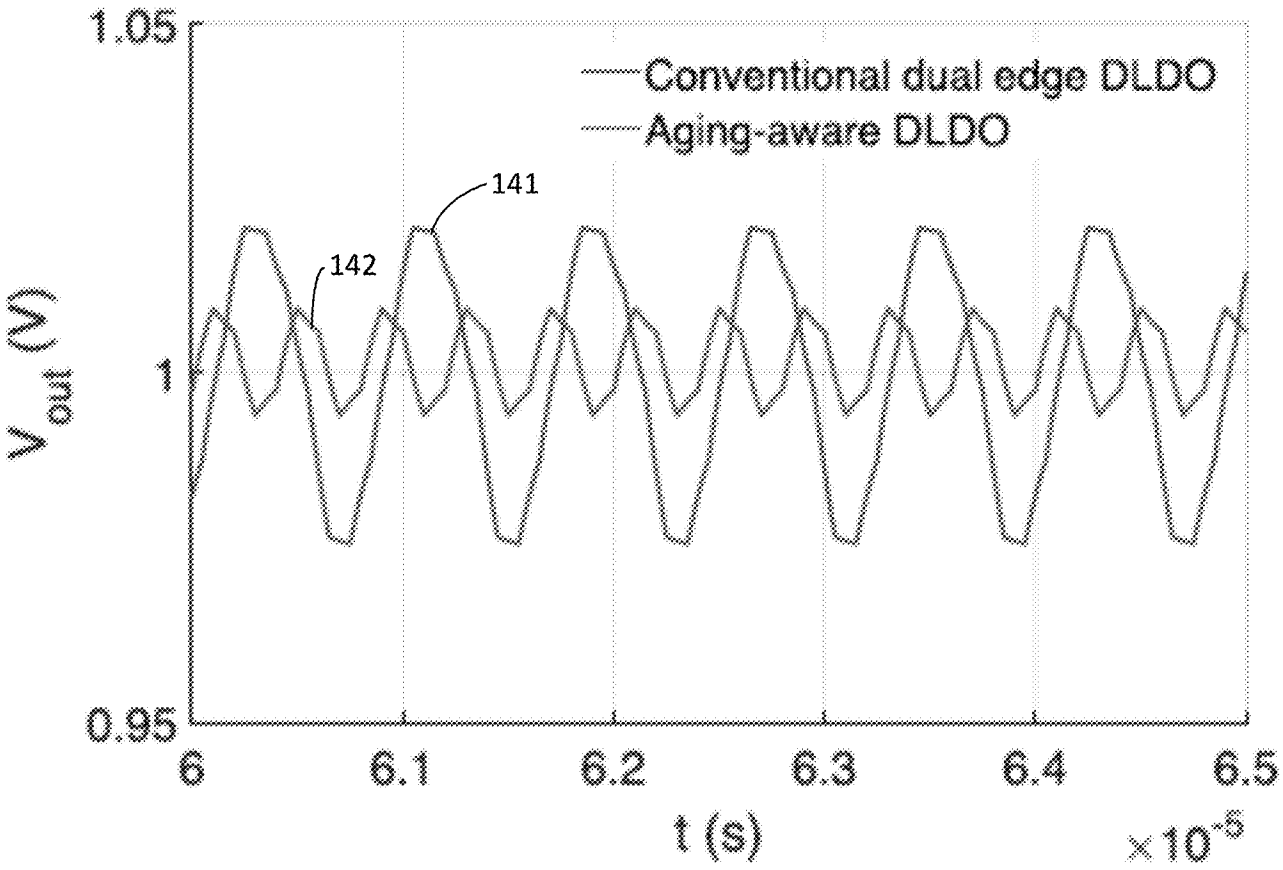
FIG. 21 is a graph of the simulated steady-state output voltages as a function of time under 10-mA load current for both conventional dual-edge (CDE) triggered DLDO of the type shown in FIG. 1 and the A-A DLDO of the type shown in FIG. 6 employing the reduced clock pulsewidth circuitry of the type shown in FIG. 13.

FIG. 21 is a graph of the simulated steady-state output voltages as a function of time under 10-mA load current for both conventional dual-edge (CDE) triggered DLDO of the type shown in FIG. 1 and the A-A DLDO of the type shown in FIG. 6 employing the reduced clock pulsewidth circuitry of the type shown in FIG. 13. Curves 141 and 142 correspond to the simulated steady-state output voltages for the CDE triggered DLDO and the A-A DLDO, respectively. LCO mode reduction from 4 to 2 and 3 times output voltage ripple amplitude reduction are achieved. As the minimum and average $I_{load}$ can be much smaller than the maximum $I_{load}$ shown in Table II, especially for LSU, light-load and medium-load conditions are experienced most of the time such that outstanding benefits can be achieved with the A-A DLDO considering the negligible power and area OH induced. It should be noted, however, that it is not necessary to use reduced pulsewidth clock triggering with the A-A DLDO 100, as many of the other benefits mentioned above may be achieved using other clock triggering schemes with the A-A DLDO 100.

In many applications, the clock frequency can be much higher than 10 MHz such as 1 GHz, for example. However, the 1-GHz sampling clock sacrifices the quiescent current. Recently, it has been known to utilize a high clock frequency for fast transient and a much lower frequency for steady-state operation. Table V shown in FIG. 22 gives the simulated maximum LCO mode under different sampling clock frequencies and load current conditions for a CDE DLDO of the type shown in FIG. 1 and for the A-A DLDO of the type shown in FIG. 6 employing the reduced clock pulsewidth circuitry of the type shown in FIG. 13. As seen from the table V, the reduced clock pulsewidth scheme demonstrates the maximum LCO mode reduction under a wide $f_{clk}$ range, especially under light-load current conditions. For a clock frequency of 1 GHz, there would be no room to further reduce the pulsewidth due to the timing constraint. However, as discussed earlier, clock frequency utilized at steady-state operation is typically much lower.

V. Tradeoff Between Area Overhead and Program Output Quality

Considering aging effects, regulators are typically designed and optimized for the expected service life of the processor. Deploying regulators optimized for a shorter service life cannot guarantee error-free operation. However, if such regulators are confined to feed error-tolerant loads, the service life can be traded for lower hardware complexity, which almost always directly translates into area savings. It should be noted that the area represents a scarce on-chip resource for distributed voltage regulators as many of these regulators are squeezed between various circuit blocks. Such area savings can enable a higher number of on-chip voltage regulators, and hence enhance the scalability of on-chip voltage regulation. A large area OH can be introduced to mitigate aging-induced transient voltage noise degradation for conventional DLDOs. The area penalty required to compensate for the aging-related deterioration of ΔV is significant, especially in the first two years. The percentage area OH also plateaus to within 10% after two years. These trends should be considered to realize optimal design based on different application environment and lifetime targets. Furthermore, leveraging the A-A DLDO 100, due to mitigation of aging-induced ΔV degradation, significant area OH savings compared to the conventional DLDO case can be achieved.

With regard to the temperature variation effects on percentage area OH (saving), analysis similar to the analysis described above with reference to FIG. 4 showed that as the temperature increases, the percentage area OH needed for the conventional DLDO to mitigate ΔV degradation increases significantly. The analysis also showed that the percentage area OH saving achieved by the A-A DLDO also greatly increases. Although the relative benefits of A-A DLDO do not improve significantly as the temperature increases, the area OH saving is considerable due to the relatively large ratio between the area of output capacitance and that of active DLDO.

Considering a 5-year aging period, an analysis was performed by the inventors of the percentage area OH within each functional unit for percentage error rate degradation mitigation utilizing bDSR and uDSR-based DLDOs. The analysis showed that with negligible area OH, the uDSR-based DLDO achieves a certain amount of error rate degradation mitigation compared to bDSR-based DLDO. Also, for the same amount of error rate degradation mitigation, the area OH needed for uDSR-based DLDO is lower than that of bDSR-based DLDO.

VI. Conclusions

As an emerging and essential part of the modern processor power delivery network, DLDOs experience serious aging-induced performance degradations including $I_{pMOS}$, $T_R$, and ΔV. In particular, DLDO degradation can increase noise in the supply voltage and further deteriorate the program output quality. Area OH needed to fully compensate these degradations can be significant, especially when a conventional DLDO design is utilized. Algorithmic noise tolerance of different processor components can be leveraged as an "area quality control knob" to alleviate the area OH requirement through scalable on-chip voltage regulation at design time. Furthermore, DLDO designed in an A-A fashion mitigates aging-induced performance degradations with negligible power and area OH. With reduced DLDO performance degradation, a significantly better area and quality tradeoff can be achieved due to A-A DLDO-induced area OH savings. Therefore, more efficient scalable on-chip voltage regulation can be realized with the A-A DLDO design. Simulation showed that up to 43.2% transient and 3× steady-state DLDO performance improvement as well as more than 10% area OH saving can be achieved utilizing the A-A paradigm disclosed herein.

It should be noted that the illustrative embodiments have been described with reference to a few embodiments for the purpose of demonstrating the principles and concepts of the invention. Persons of skill in the art will understand how the principles and concepts of the invention can be applied to other embodiments not explicitly described herein. For example, while the uDSR has been described with reference to FIG. 6 as having a particular configuration, those skilled in the art will understand that many modifications can be made to the configuration shown in FIG. 6 while still achieving the goals and benefits described herein. As will be understood by those skilled in the art in view of the description provided herein, such modifications are within the scope of the invention.

What is claimed is:

1. A digital low-dropout voltage regulator (DLDO), the DLDO comprising:

a digital controller configured to activate or deactivate one or more power transistors, the digital controller comprising an input terminal, a clock terminal, and one or more output terminals, the input terminal configured to receive a comparator output voltage from a clocked comparator, the clock terminal configured to receive a DLDO clock signal, the one or more output terminals electrically coupled to the one or more power transistors corresponding to the one or more output terminals; and a clock pulsewidth reduction circuit configured to receive an input clock signal having a first pulsewidth and to generate the DLDO clock signal having a preselected pulsewidth, the preselected pulsewidth of the DLDO clock signal being smaller than the first pulsewidth of the input clock signal, the clock pulsewidth reduction circuit comprising an output terminal being electrically coupled to the clocked comparator and the clock terminal of the digital controller for delivering the DLDO clock signal to the clocked comparator and to the digital controller.

2. The DLDO of claim 1, further comprising:

a clocked comparator circuit comprising a first input terminal, a second input terminal, an output terminal, and a clock terminal, the first input terminal configured to receive a reference voltage, the second input terminal configured to receive an output voltage of the DLDO, the clock terminal configured to receive the DLDO clock signal, and the clocked comparator circuit comparing the reference voltage with the output voltage and outputting the comparator output voltage to the input terminal of the digital controller.

3. The DLDO of claim 2, further comprising:

the one or more power transistors electrically connected in parallel with one another, each power transistor having first, second and third terminals, the first terminal of each power transistor of the one or more power transistors being electrically coupled to an output terminal of the one or more output terminals of the digital controller, the second terminal of each power transistor being electrically coupled to an input voltage of the DLDO, the third terminal of each power transistor being electrically coupled to the output voltage of the DLDO.

4. The DLDO of claim 1, wherein the digital controller comprises a bi-directional shift register.

5. The DLDO of claim 1, wherein the digital controller comprises a uni-directional shift register.

6. The DLDO of claim 5, wherein the digital controller activates or deactivates the one or more power transistors such that electrical stress is substantially evenly distributed among the one or more power transistors over time to mitigate performance degradation of the DLDO.

7. The DLDO of claim 5, wherein a first output terminal of the one or more output terminals outputs a first control signal, wherein a second output terminal of the one or more output terminals outputs a second control signal, wherein the second output terminal is adjacent to the first output terminal, and wherein the second control signal is output based on the first control signal, the second control signal, and the comparator output voltage.

8. The DLDO of claim 7, wherein the first control signal and the second control signal are input to a first XOR logic gate, and wherein the first control signal and the comparator output voltage are input to a second XOR logic gate, wherein a first output of the first XOR logic gate and a second output of the second XOR logic gate are input to an AND logic gate, wherein an output of the AND logic gate is input to a T flip-flop, and wherein an output of the T flip-flop is the second control signal.

9. The DLDO of claim 5, wherein the one or more power transistors are disposed in parallel, and wherein the digital controller turn an inactive power transistor at a first boundary of the one or more power transistors ON if the comparator output voltage is a logic high and turn an active power transistor at a second boundary of the one or more power transistors OFF if the comparator output voltage is a logic low.

10. The DLDO of claim 1, wherein the input clock signal and the DLDO clock signal have a same frequency, and wherein the input clock signal has a duty cycle that is greater than a duty cycle of the DLDO clock signal.

11. The DLDO of claim 10, wherein the preselected pulsewidth of the DLDO clock signal is less than half the first pulsewidth of the input clock signal.

12. A method for mitigating performance degradation in a digital low-dropout voltage regulator (DLDO), the method comprising:

in a digital controller, activating or deactivating one or more power transistors;

in an input terminal of the digital controller, receiving a comparator output voltage from a clocked comparator;

in a clock terminal of the digital controller, receiving a DLDO clock signal;

electrically coupling one or more output terminals of the digital controller with the one or more power transistors corresponding to the one or more output terminals;

in a clock pulsewidth reduction circuit, receiving an input clock signal having a first pulsewidth;

in a clock pulsewidth reduction circuit, generating the DLDO clock signal having a preselected pulsewidth, the preselected pulsewidth of the DLDO clock signal being smaller than the first pulsewidth of the input clock signal; and delivering the DLDO clock signal to the clocked comparator and to the digital controller.

13. The method of claim 12, further comprising:

in a first input terminal of a clocked comparator circuit, receiving a reference voltage;

in a second input terminal of the clocked comparator circuit, receiving an output voltage of the DLDO;

in a clock terminal of the clocked comparator circuit, receiving the DLDO clock signal;

in the clocked comparator circuit, comparing the reference voltage with the output voltage; and in the clocked comparator circuit, outputting the comparator output voltage to the input terminal of the digital controller.

14. The method of claim 13, further comprising:

electrically connecting the one or more power transistors in parallel with one another, electrically coupling a first terminal of each power transistor of the one or more power transistors with an output terminal of the one or more output terminals of the digital controller;

electrically coupling a second terminal of each power transistor of the one or more power transistors with an input voltage of the DLDO; and electrically coupling a third terminal of each power transistor of the one or more power transistors with the output voltage of the DLDO.

15. The method of claim 13, wherein the activating or deactivating the one or more power transistors is such that electrical stress is substantially evenly distributed among the one or more power transistors over time to mitigate performance degradation of the DLDO.

16. The method of claim 13, wherein a first output terminal of the one or more output terminals outputs a first control signal, wherein a second output terminal of the one or more output terminals outputs a second control signal, wherein the second output terminal is adjacent to the first output terminal, and wherein the second control signal is output based on the first control signal, the second control signal, and the comparator output voltage.

17. The method of claim 16, wherein the first control signal and the second control signal are input to a first XOR logic gate, wherein the first control signal and the comparator output voltage are input to a second XOR logic gate, wherein a first output of the first XOR logic gate and a second output of the second XOR logic gate are input to an AND logic gate, wherein an output of the AND logic gate is input to a T flip-flop, and wherein an output of the T flip-flop is the second control signal.

18. The method of claim 13, further comprising:

in the digital controller, turning an inactive power transistor at a first boundary of the one or more power transistors ON if the comparator output voltage is a logic high; and in the digital controller, turning an active power transistor at a second boundary of the one or more power transistors OFF if the comparator output voltage is a logic low, wherein the one or more power transistors are disposed in parallel.

19. The method of claim 13, wherein the input clock signal and the DLDO clock signal have a same frequency, and wherein the input clock signal has a duty cycle that is greater than a duty cycle of the DLDO clock signal.

20. The method of claim 19, wherein the preselected pulsewidth of the DLDO clock signal is less than half the first pulsewidth of the input clock signal.

* * * * *